US009158236B2

(12) United States Patent
Tomoda et al.

(10) Patent No.: US 9,158,236 B2
(45) Date of Patent: Oct. 13, 2015

(54) IMAGE FORMING APPARATUS HAVING REDUCED MANUFACTURING COSTS, AND IMAGE FORMING UNIT AND DEVELOPING UNIT INCLUDED THEREIN

(71) Applicant: KONICA MINOLTA, INC., Chiyoda-ku, Tokyo (JP)

(72) Inventors: Yasuaki Tomoda, Toyohashi (JP); Naoki Nonoyama, Toyokawa (JP); Yoshitaka Kuroda, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/109,488

(22) Filed: Dec. 17, 2013

(65) Prior Publication Data

US 2014/0193179 A1 Jul. 10, 2014

(30) Foreign Application Priority Data

Jan. 7, 2013 (JP) ..... 2013-000621

(51) Int. Cl.
*G03G 15/09* (2006.01)
*G03G 21/18* (2006.01)

(52) U.S. Cl.
CPC ..... *G03G 15/0935* (2013.01); *G03G 21/1821* (2013.01); *G03G 21/1825* (2013.01)

(58) Field of Classification Search
CPC ..... G03G 15/0813; G03G 21/1821; G03G 15/0935; G03G 21/1825
USPC ..... 399/113, 267
See application file for complete search history.

(56) References Cited

U.S. PATENT DOCUMENTS 4,639,119 A * 1/1987 Isaka ..... 399/113
5,283,619 A * 2/1994 Nomura et al.

(Continued)

FOREIGN PATENT DOCUMENTS

JP 57185449 A 11/1982
JP 61036761 A * 2/1986

(Continued)

OTHER PUBLICATIONS

Japanese Office Action (and English translation thereof) dated Mar. 3, 2015, issued in counterpart Japanese Application No. 2013-000621.

*Primary Examiner* — Walter L Lindsay, Jr.
*Assistant Examiner* — Milton Gonzalez
(74) *Attorney, Agent, or Firm* — Holtz, Holtz, Goodman & Chick PC

(57) ABSTRACT

An image forming apparatus supplies toner to an electrostatic latent image on a circumferential surface of a photosensitive rotating member to develop the electrostatic latent image, and includes: a photosensitive unit including the photosensitive rotating member and a pair of support frames rotatably supporting the photosensitive rotating member at its axial ends; a developing unit including a developing sleeve that is longer in its rotational axis direction than an element tube of the photosensitive rotating member in its rotational axis direction, and a pair of bearings provided outward from axial ends of the element tube and rotatably holding the developing sleeve at its axial ends; and a forcing member relatively forcing the developing unit toward the photosensitive unit to bring the bearings into abutment with the respective support frames, such that a gap between the developing sleeve and the photosensitive rotating member is maintained at a predetermined value.

23 Claims, 15 Drawing Sheets

(56) References Cited

U.S. PATENT DOCUMENTS

| | | | | |
|---|---|---|---|---|
| 5,659,861 | A * | 8/1997 | Yamashita et al. | 399/267 |
| 5,701,562 | A | 12/1997 | Araki et al. | |
| 5,768,658 | A * | 6/1998 | Watanabe et al. | |
| 6,249,659 | B1 | 6/2001 | Stickler | |
| 6,269,235 | B1 * | 7/2001 | Nishiyama | 399/267 |
| 6,275,668 | B1 * | 8/2001 | Batori | |
| 2002/0064390 | A1 | 5/2002 | Oguma et al. | |
| 2006/0159493 | A1 | 7/2006 | Itagaki et al. | |
| 2009/0074449 | A1 | 3/2009 | Katayama et al. | |
| 2010/0329735 | A1 * | 12/2010 | Kinoshita | |
| 2012/0321342 | A1 * | 12/2012 | Mori | |

FOREIGN PATENT DOCUMENTS

| | | | | |
|---|---|---|---|---|
| JP | 02-047680 | A | | 2/1990 |
| JP | 03098067 | A | | 4/1991 |
| JP | 04369665 | A | | 12/1992 |
| JP | 05053437 | A | | 3/1993 |
| JP | 05100510 | A | | 4/1993 |
| JP | 06186798 | A | | 7/1994 |
| JP | 06332307 | A | | 12/1994 |
| JP | 06332317 | A | | 12/1994 |
| JP | 07028333 | A | | 1/1995 |
| JP | 11-161015 | A | | 6/1999 |
| JP | 2001312142 | A | | 11/2001 |
| JP | 2002162827 | A | | 6/2002 |
| JP | 2003186286 | A | | 7/2003 |
| JP | 2003215900 | A | | 7/2003 |
| JP | 2005004057 | A | | 1/2005 |
| JP | 2006030505 | A | * | 2/2006 |
| JP | 2006221147 | A | | 8/2006 |
| JP | 2007127973 | A | | 5/2007 |
| JP | 2008-116657 | A | | 5/2008 |
| JP | 2009075211 | A | | 4/2009 |

* cited by examiner

IMAGE FORMING APPARATUS HAVING REDUCED MANUFACTURING COSTS, AND IMAGE FORMING UNIT AND DEVELOPING UNIT INCLUDED THEREIN

This application is based on application No. 2013-000621 filed in Japan, the contents of which are hereby incorporated by reference.

BACKGROUND OF THE INVENTION (1) Field of the Invention

The present invention relates to an image forming apparatus such as a printer, and particularly relates to an image forming apparatus that include a mechanism for maintaining a gap between a photosensitive drum and a developing roller at a defined value, and an image forming unit and a developing unit included in the image forming apparatus.

(2) Related Art

An image forming apparatus employing an electronic photography system such as a printer performs image formation by exposure-scanning a circumferential surface of a photosensitive drum to form an electrostatic latent image, supplying toner to the electrostatic latent image for development from a developing device via a developing roller, and transferring a toner image onto a recording sheet.

A developing device employing a two-component developing system, among various types of developing devices, for example has a structure in which a developing roller includes a cylindrical developing sleeve into which a magnet roller is inserted. Generally, a flange having a rotational shaft which is vertically provided on the center thereof is attached to an opening of each of ends of a developing sleeve, and the developing sleeve is pivotally supported by the rotational shaft so as to be rotatable relative to a housing of the developing device.

By the way, in order to excellently form a toner image on a photosensitive drum, it is necessary to maintain a gap between a circumferential surface of a developing sleeve and a circumferential surface of the photosensitive drum at a predetermined defined value with a high precision. Such a gap is hereinafter referred to as a development gap.

For this reason, conventional image forming apparatuses for example have the following structure such as disclosed in Japanese Patent Application Publication No. H11-161015. A developing sleeve has a rotational shaft to which a roller for controlling a gap (hereinafter, DS roller) is attached whose outer diameter is slightly longer than a diameter of the developing sleeve, and a developing roller is forced toward a photosensitive drum to bring a circumferential surface of the DS roller into abutment with a circumferential surface of the photosensitive drum, thereby maintaining a development gap at a defined value.

However, abutment of the DS roller with the photosensitive drum might obstruct smooth rotation of the photosensitive drum due to abrasion of a part of the photosensitive drum which is in abutment with the DS roller, a load torque which prevents rotation of the photosensitive drum, or the like. Since many image forming apparatuses recently have adopted a structure of rotating a developing sleeve in a direction counter to a rotational direction of a photosensitive drum in order to efficiently supply toner to a developing position, the abrasion and load torque as described exercise a significant negative influence on smooth rotation of the photosensitive drum especially in the image forming apparatuses adopting such a structure.

In view of this, there has proposed a structure of bring the DS roller not into direct abutment with the photosensitive drum but into partial abutment with support frames which support ends of the photosensitive drum so as to secure a development gap.

FIG. 15 is a cross-sectional view of a photosensitive unit 500 and a developing unit 503 which adopt the above structure. FIG. 15 shows respective ends of the photosensitive unit 500 and the developing unit 503 at only one side in a longitudinal direction thereof.

As shown in FIG. 15, the developing unit 503 has the structure in which a flange 505 which is integrally formed with a rotational shaft 5051 is attached to each of ends of a developing sleeve 504, the rotational shaft 5051 is held by a slide bearing 507 so as to be rotatable relative to a housing 506, and a DS roller 508 is attached to the end of the rotational shaft 5051.

The housing 506 of the developing unit 503 is forced toward the photosensitive drum 501 by an elastic member which is not illustrated. This brings the DS roller 508 into abutment with a corresponding one of support frames 502 which support both ends of the photosensitive drum 501, thereby maintaining a development gap G to a defined value.

According to the structure such as shown in FIG. 15, since the DS roller 508 is out of contact with the photosensitive drum 501, it is possible to prevent abrasion of the photosensitive drum 501 and decrease of a rotation driving force due to a load torque.

However, this structure requires that the rotational shaft 5051 should have a longer length than a conventional one in order to bring the DS roller 508 into abutment with the support frame 502 which is provided outward from ends of the photosensitive drum 501 in a rotational axis direction of the photosensitive drum 501.

The flange 505 and the rotational shaft 5051, which are integrally formed, are generally formed by cutting and machining a thick round bar of metal so as to secure a certain degree of strength. The longer the rotational shaft 5051 is, the longer a round bar of metal is necessary and the longer a period for cutting and machining the rotational shaft 5051 is also necessary. This causes a problem of increase in manufacturing costs.

In response to this problem, there has proposed a method of assembling the flange 505 and the rotational shaft 5051 as separate parts and then integrating them with each other. However, this method requires an increased number of components, and results in a large tolerance between the components (dimensional tolerance). This might disable to secure the development gap G as the defined value.

SUMMARY OF THE INVENTION

The present invention aims to provide an image forming apparatus having reduced manufacturing costs of developing units and maintaining a development gap at a defined value, and am image forming unit and a developing unit that are included in the image forming apparatus.

In order to achieve the above aim, a first aspect of the present invention provides an image forming apparatus that supplies toner to an electrostatic latent image formed on a circumferential surface of a photosensitive rotating member to develop the electrostatic latent image, the image forming apparatus comprising: a photosensitive unit that includes the photosensitive rotating member and a pair of support frames, the support frames rotatably supporting the photosensitive rotating member at axial ends thereof; a developing unit that includes a developing sleeve and a pair of bearings, the developing sleeve being longer in a rotational axis direction thereof than an element tube of the photosensitive rotating member in a rotational axis direction thereof, the bearings being provided outward from axial ends of the element tube and rotatably holding the developing sleeve at edges of axial ends thereof; and a forcing member that relatively forces the developing unit toward the photosensitive unit to bring each of the bearings into abutment with an abutment part of a corresponding one of the support frames, such that a gap between the developing sleeve and the photosensitive rotating member is maintained at a predetermined value.

Also, in order to achieve the above aim, a second aspect of the present invention provides an imaging unit that supplies toner to an electrostatic latent image formed on a circumferential surface of a photosensitive rotating member to develop the electrostatic latent image, the image forming apparatus comprising: a photosensitive unit that includes the photosensitive rotating member and a pair of support frames, the support frames rotatably supporting the photosensitive rotating member at axial ends thereof; a developing unit that includes a developing sleeve and a pair of bearings, the developing sleeve being longer in a rotational axis direction thereof than an element tube of the photosensitive rotating member in a rotational axis direction thereof, the bearings being provided outward from axial ends of the element tube and rotatably holding the developing sleeve at edges of axial ends thereof; and a forcing member that relatively forces the developing unit toward the photosensitive unit to bring each of the bearings into abutment with an abutment part of a corresponding one of the support frames, such that a gap between the developing sleeve and the photosensitive rotating member is maintained at a predetermined value.

Also, in order to achieve the above aim, a third aspect of the present invention provides a developing unit that includes a developing sleeve, and is relatively forced toward a photosensitive unit such that a gap between the developing sleeve and a photosensitive rotating member included in the photosensitive unit is maintained at a predetermined value, the developing unit comprising: a pair of bearings that rotatably hold the developing sleeve at edges of axial ends thereof; and a pair of support parts that each support a corresponding one of the bearings by being brought into contact with the bearing, wherein the developing sleeve is longer in a rotational axis direction thereof than an element tube of the photosensitive rotating member in a rotational axis direction thereof, the bearings are provided outward from axial ends of the element tube, and the gap is maintained at the predetermined value by the developing unit being relatively forced to bring each of the bearings into abutment with an abutment part of a corresponding one of a pair of support frames included in the photosensitive unit.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIG. 2A shows a state where a developing unit is forced toward a photosensitive unit to set a development gap therebetween to a defined value, and FIG. 2B shows a state in which application of a force to the developing unit is cancelled to separate the photosensitive unit and the developing unit from each other;

DESCRIPTION OF PREFERRED EMBODIMENTS

The following explains an embodiment of an image forming apparatus relating to the present invention, with use of an example of a tandem-type color printer (hereinafter, referred to just as a printer).

(1) Structure of Printer

Figure 1:
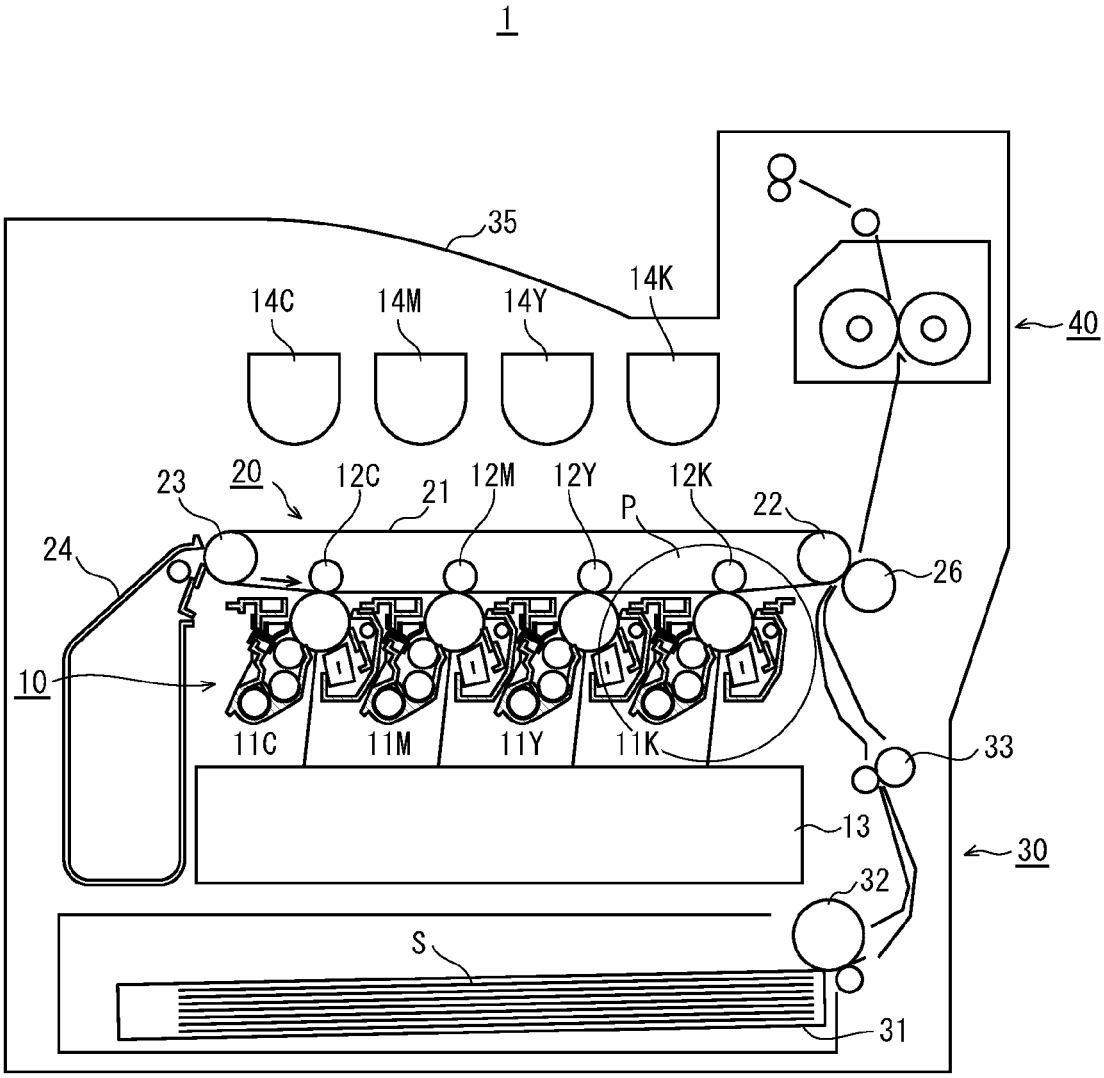
FIG. 1 is a schematic cross-sectional view of a structure of a tandem-type color printer relating to an embodiment of the present invention.

FIG. 1 is a schematic cross-sectional view of the overall structure of a printer 1.

The printer 1 forms an image based on image data input from an external terminal which is not illustrated according to a known electronic photography system. Also, the printer 1 includes an image process unit 10, an intermediate transfer unit 20, a paper feed unit 30, and a fixing unit 40.

The image process unit 10 includes image forming units 11C, 11M, 11Y, and 11K that form respective toner images corresponding to colors of cyan (C), magenta (M) yellow (Y), and black (K), an exposure-scanning unit 13 that exposurescans a photosensitive drum 101 (FIG. 2) of each of the forming units 11C, 11M, 11Y, and 11K, and toner bottles 14C, 14M, 14Y, and 14K that house therein toner to be supplied to the image forming units 11C, 11M, 11Y, and 11K, respectively.

The intermediate transfer unit 20 includes an intermediate transfer belt 21 that stretches and lays on a driving roller 22 and a driven roller 23 so as to be substantially horizontal and is driven to rotate in a direction indicated by an arrow in FIG. 1, a cleaning unit 24 that removes toner remaining on a circumferential surface of the intermediate transfer belt 21 and collects the removed toner, and so on.

The paper feed unit 30 includes a paper feed tray 31, a pickup roller 32 that comes into abutment with the top one of recording sheets S housed in the paper feed tray 31 to rotate to pick up the recording sheet S to a conveyance path, and a timing roller pair 33 that sends out the recording sheet S downstream of the conveyance direction in accordance with a predetermined timing.

The toner images of the respective colors, which have been formed by the image forming units 11C to 11K, are transferred on the same position on the circumferential surface of the intermediate transfer belt 21 so as to be layered inside of the rotation path of the intermediate transfer belt 21, by an electrostatic force of a voltage applied to primary transfer rollers 12C, 12Y, 12M, and 12K corresponding in position to the image forming units 11C to 11K. As a result, a full color toner image is formed.

Then, the toner image, which has been primarily transferred onto the intermediate transfer belt 21, is secondarily transferred onto the recording sheet S by an electrostatic force applied from the secondary transfer roller 26 to which a predetermined voltage is applied.

The recording sheet S on which the toner image is transferred, is thermally fixed by the fixing unit 40, and then is ejected onto a paper ejection tray 35.

In order to perform image formation of only black color, only the image forming unit 11K is driven, and a separation mechanism which is not illustrated relatively separates the image forming units 11C to 11Y from the intermediate transfer belt 21, and stops the image forming units 11C to 11Y.

The following describes a specific structure of the image forming units 11C to 11K included in the image process unit 10, and describes in detail especially a structure for maintaining a development gap between the photosensitive drum and the developing sleeve at a defined value.

(2) Structure of Image Forming Units

The image forming units 11C to 11K have basically the same structure, excepting toner of different colors to be supplied. Accordingly, the following describes the structure of the image forming unit 11K of black color.

Figure 2B:
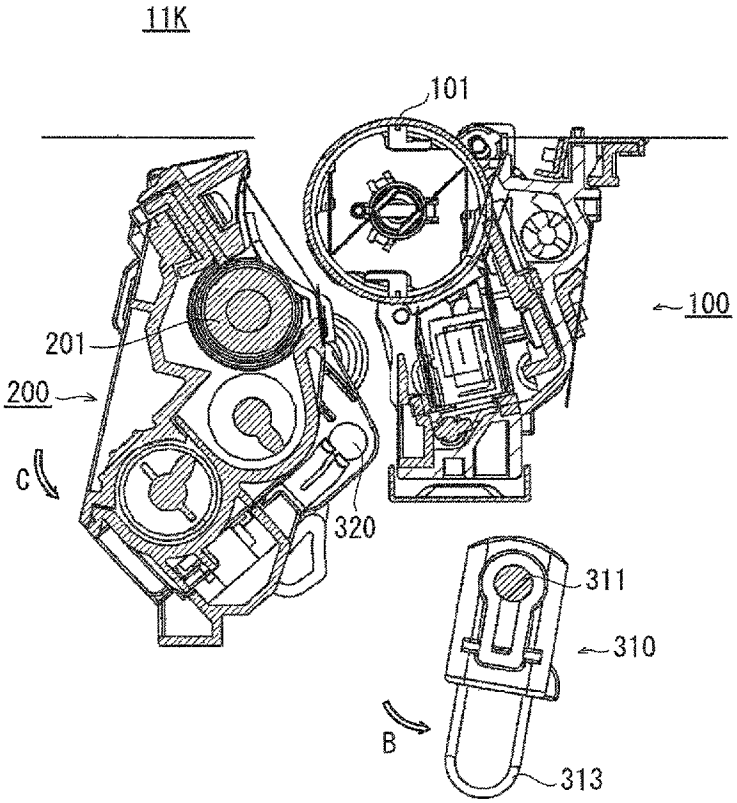
FIG. 2A and FIG. 2B are cross-sectional views showing an image forming unit of back color included in the color printer shown in FIG. 1, where
Figure 2A:
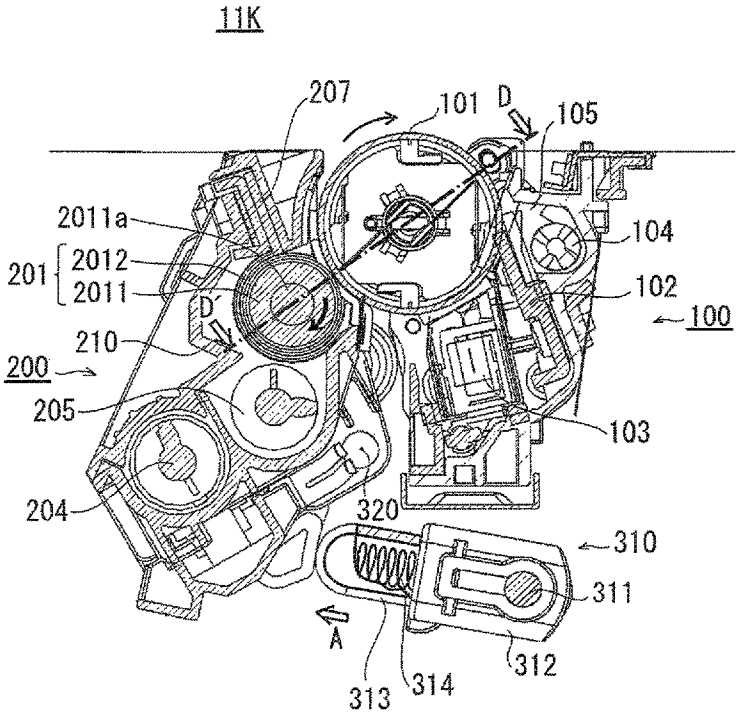

FIG. 2A is a cross-sectional view of the image forming unit 11K which is indicated by a circle P in FIG. 1, taken perpendicular to a rotational axis of the photosensitive drum 101. In FIG. 2A, a forcing lever 310 is partially cut.

As shown in FIG. 2A, the image forming unit 11K has the structure in which a photosensitive unit 100 including the photosensitive drum 101 and a developing unit 200 including a developing roller 201 are provided so as to face each other in parallel.

The photosensitive unit 100 includes, in addition to the photosensitive drum 101 described above, a cleaning blade 102 that removes toner remaining on a circumferential surface of the photosensitive drum 101, a charger 103 that charges the circumferential surface of the photosensitive drum 101 so as to have a predetermined potential, a toner collection unit 105, and so on.

The toner, which is removed by the cleaning blade 102, is collected by the toner collection unit 105. Then, the collected toner is conveyed by a rotating screw 104 from a near side toward a far side in a direction perpendicular to a plane of paper of FIG. 2A. The toner naturally drops into a collection case which is not illustrated, and is collected.

On the other hand, the developing unit 200 is a detachable unit-type developing device. The developing unit 200 includes, in addition to the developing roller 201 described above, a first stirring screw 204, a second stirring screw 205, a doctor blade 207, a housing 210, and so on. The first stirring screw 204 conveys toner from the near side toward the far side while stirring the toner. The second stirring screw 205 supplies the toner to the surface of the developing roller 201 while conveying the toner toward the near side. The doctor blade 207 controls the toner adhered onto the surface of the developing roller 201 so as to have a constant thickness or height. The housing 210 supports these members and houses therein a two-component developer composed of toner and magnetic carrier which is not illustrated.

The developing roller 201 includes a developing sleeve 2012 into which a magnet roller 2011 inserted. The developing sleeve 2012 is rotatably held. The magnet roller has a shaft 2011*a* which is unroratably supported.

Note that the developing sleeve 2012 has the structure in which an outer circumferential surface of one of ends thereof in a rotational axis direction thereof is in sliding contact with a rectangular metal piece having an excellent conductivity which is not illustrated such as a phosphor copper. A developing bias voltage is applied to the developing sleeve 2012 via the metal piece.

The housing 210 of the developing unit 200 is pivotally supported by a spindle pin 320 of a main body of the printer 1. Also, the housing 210 is forced by the forcing lever 310 thereby to receive a clockwise rotational moment.

A state of the developing unit 200 in which such a rotational moment occurs is hereinafter referred to as a forced state.

The developing unit 200 is normally set in such a forced state, and image formation is performed as follows. In the photosensitive unit 100, after toner remaining on the circumferential surface of the photosensitive drum 101 is removed by the cleaning blade 102, the circumferential surface of the photosensitive drum 101 is uniformly charged by the charger 103 so as to have a predetermined potential. Then exposure-scanning is performed on the circumferential surface of the photosensitive drum 101 with laser beam by the exposure-scanning unit 13 (FIG. 1). As a result, an electrostatic latent image of black color is formed on the circumferential surface of the photosensitive drum 101 (FIG. 2A).

On the other hand, in the developing unit 200, a toner layer adhered onto the circumferential surface of the developing sleeve 2012 is adjusted by the doctor blade 207 so as to have a constant thickness, and is charged due to abrasion with the doctor blade 207. Then, the toner layer is conveyed to a developing position facing the photosensitive drum 101 through rotation of the developing sleeve 2012. As a result, the toner layer is supplied to the circumferential surface of the photosensitive drum 101, and an electrostatic latent image is developed to form a toner image.

The forcing lever 310 has the structure in which a hollow pressing body 313 is slidably inserted into a lever main body 312 which is pivotally supported by a rotating shaft 311, and a compression spring 314 which is incorporated into the pressing body 313 is pressed in a direction indicated by an arrow A in FIG. 2A. Upon replacement of developing unit, the forcing lever 310 is made to swing in a direction indicated by an arrow B to cancel application of a force to the developing unit 200, as shown in FIG. 2B.

As a result, the developing unit 200 swings around the spindle pin 320 in a direction indicated by an arrow C in FIG. 2B thereby to separate from the photosensitive unit 100. This facilitates unit replacement.

(3) Structure of Developing Unit

Figure 3A:
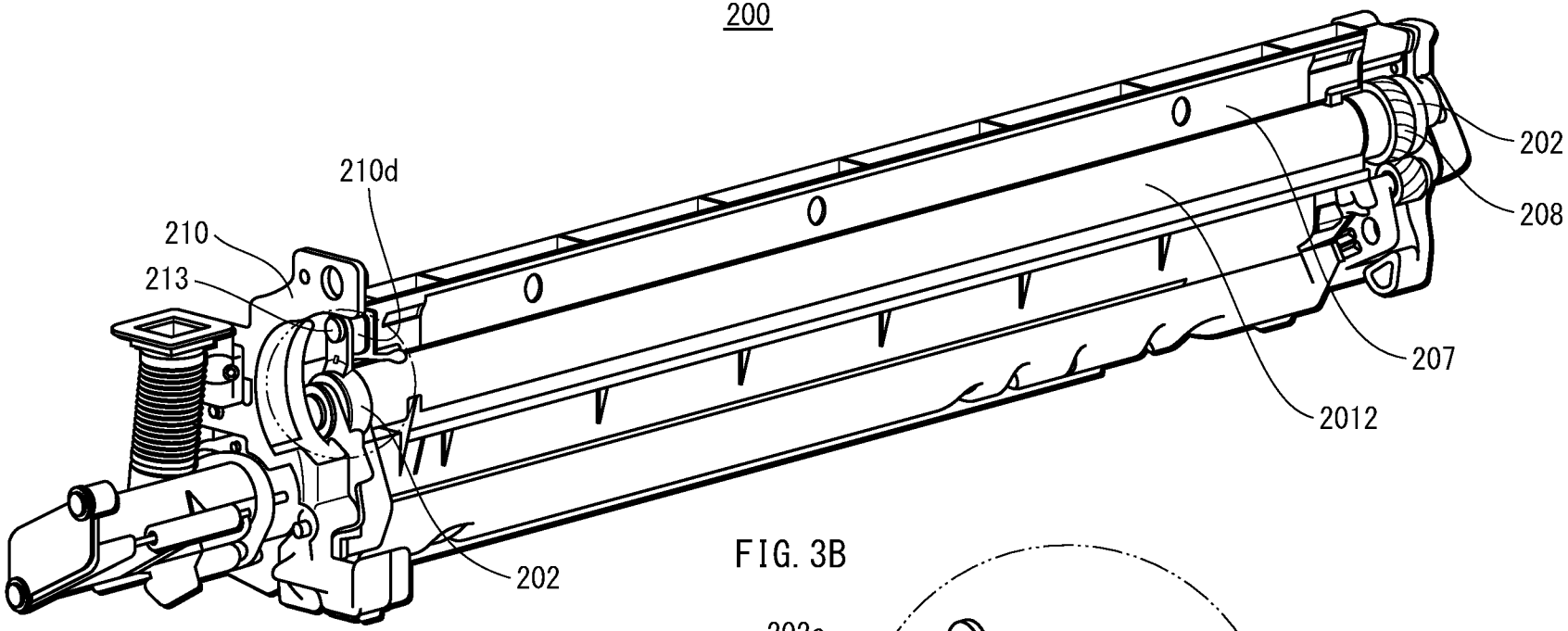
FIG. 3A is a perspective view of a developing unit of the image forming unit of back color.
Figure 3B:
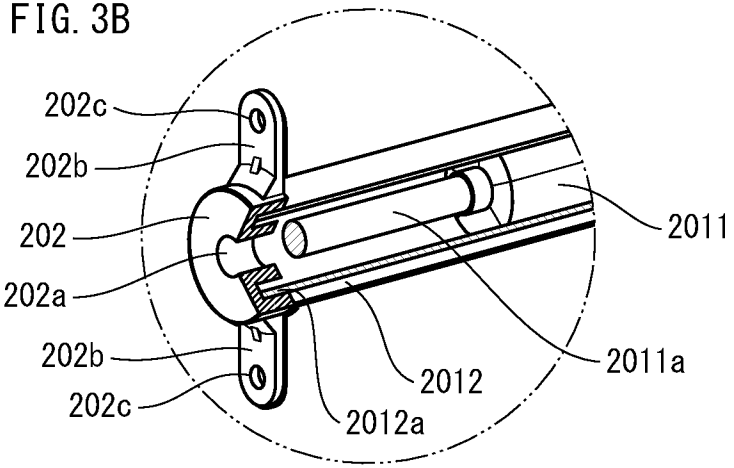
FIG. 3B is a partially cut perspective view of a main part of the developing unit shown in FIG. 3A.

FIG. 3A is a perspective view of the developing unit 200, and FIG. 3B is a partially cut perspective view of a main part of the developing unit 200 shown in FIG. 3A.

The developing sleeve 2012 is a cylindrical and nonmagnetic member which extends in the rotational axis direction, as shown in FIG. 3A. The developing sleeve 2012 has an edge 2012*a* of each of both ends thereof (hereinafter, referred to as an end edge 2012*a*) which is held via a cap-shaped bearing 202 such that the developing sleeve 2012 is rotatable relative to the housing 210, as shown in FIG. 3B.

The bearing 202 is a slide bearing, and has an inner circumferential surface which is in sliding contact with an outer circumferential surface of the end edge 2012*a* of the developing sleeve 2012. The details are described later.

The developing sleeve 2012 is a pipe formed from a nonmagnetic metal such as an aluminum and an austenitic stainless steel. In the present embodiment, the developing sleeve 2012 is a pipe which has a thickness of 0.5 mm and an outer diameter of 16 mm. However, the thickness and the outer diameter are appropriately determined depending on the specifications and the design conditions, and accordingly are not limited to the above values.

The outer circumferential surface of the end edge 2012*a* which is in sliding contact with the bearing 202 has undergone a nickel plating process. This improves the slidability and the abrasion resistance of the developing sleeve 2012 compared with the case where nickel plating process is not performed.

Figure 4:
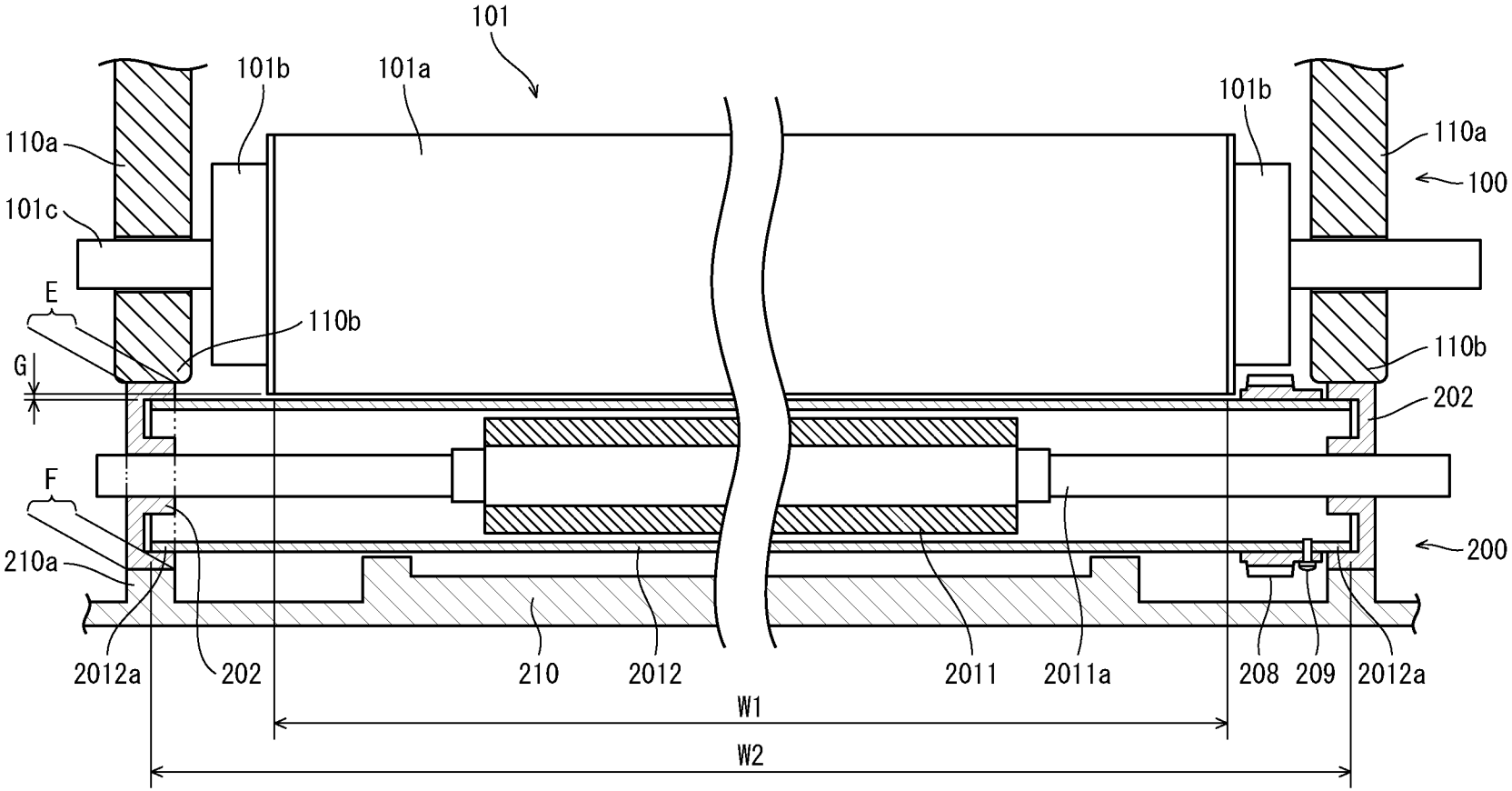
FIG. 4 is a cross-sectional view of the image forming unit cut along a plane D-D' passing through respective rotational axes of the photosensitive drum and the developing sleeve shown in FIG. 2A.

Also, an external gear with a boss (hereinafter, referred to as a boss external gear) 208 is externally fitted into one of the ends of the developing sleeve 2012 (FIG. 3A), and is fixed by a screw 209 (FIG. 4). The boss external gear 208 enables transmission of a driving force from a driving source which is not illustrated to the developing sleeve 2012.

In the present embodiment, the developing sleeve 2012 is driven to rotate in a direction counter to a rotational direction of the photosensitive drum 101. This enables efficient supply of toner to a position of the developing sleeve 2012 which is proximate to the photosensitive drum 101 (developing position).

The bearing 202 is a slide bearing formed from a resin. As shown in FIG. 3B, the bearing 202 has an inner circumferential surface which is in sliding contact with the outer circumferential surface of the developing sleeve 2012, thereby to rotatably hold the developing sleeve 2012. Also, the bearing 202 has a boss part 202*a* at the center thereof.

The shaft 2011*a* of the magnet roller 2011 is loosely inserted into the boss part 202*a* (FIG. 4). Both ends of the shaft 2011*a* which are not illustrated are fixed to the housing 210, thereby to disable rotation of the magnet roller 2011.

The bearing 202 should desirably be formed from a resin material having an excellent slidability such as a polyacetal resin, and desirably be formed by a manufacturing method with a high dimensional accuracy such as a mold injection method.

A part of the bearing 202 which is in sliding contact with the developing sleeve 2012 has an inner diameter such that a clearance between the bearing 202 and the developing sleeve 2012 is reduced as small as possible as long as sliding friction is reduced as small as possible. This reduces the tolerance of a development gap G which is described later.

In the present embodiment, the clearance is set to have a value within a range of 0.01 mm to 0.07 mm.

Also, the bearing 202 has two screw attaching parts 202*b* that each have a through-hole 202*c* for screw fastening and extend in radially opposite directions from an outer circumferential surface of the bearing 202. The bearing 202 is fixed by a screw 213 to a support part 210*a* of the housing 210 of the developing unit 200.

Note that FIG. 3A shows a state in which only one of the two screw attaching parts 202*b* is visible while the other is invisible behind the developing unit 200.

(4) Structure for Controlling Development Gap

FIG. 4 is a cross-sectional view of the image forming unit cut along a plane D-D' passing through the respective rotational axes of the photosensitive drum 101 and the developing sleeve 2012 of the developing unit 200 in the forced state shown in FIG. 2A, where the center part of the image forming unit in the longitudinal direction is omitted.

As shown in FIG. 4, the magnet roller 2011 is inserted into the cylindrical developing sleeve 2012:

An electrostatic latent image is formed in a region of the photosensitive drum 101 which faces the magnet roller 2011 (image formation region).

However, both ends of an element tube 101*a* of the photosensitive drum 101 are excluded from this image formation region. This is because a photosensitive layer coated on the element tube 101*a* tends to have a uneven thickness on the ends of the element tube 101*a*, and as a result it is difficult to ensure image quality.

Here, the element tube 101*a* indicates a circular cylindrical part of the photosensitive drum 101 excluding respective flanges 101*b* provided on the both ends of the photosensitive drum 101.

A driving shaft 101*c* penetrates through the center of the flanges 101*b*, which are provided on the both ends of the photosensitive drum 101, thereby to be attached to the flanges 101*b*. A driving gear which is not illustrated is attached to an end of the driving shaft 101*c* at a back side of the printer 1, and is driven to rotate by a driving source provided at a side of the main body of the printer 1.

As shown in FIG. 4, the developing sleeve 2012 of the developing unit 200 relating to the present embodiment has a length W2 in the rotational axis direction which is longer than a length W1 of the element tube 101*a* of the photosensitive drum 101 in the rotational axis direction. Also, the end edge 2012*a* is directly held by the bearing 202 such that the developing sleeve 2012 is rotatable.

As described above, the bearing 202 is fixed to a mounting seat 210*d* of the housing 210 of the developing unit 200 by the screw 213 (FIG. 3A). Also, when the developing unit 200 is in the forced state, part of the outer circumferential surface of each of the bearings 202 is in abutment with an abutment part 110*b* which is part of a corresponding one of support frames 110*a* which support the ends of the photosensitive drum 101. In the present embodiment, the abutment part 110*b* is part of the support frame 110*a*. Alternatively, the abutment part 110*b* is not necessarily incorporated into the support frame 110*a* as long as the abutment part 110*b* is fixed to the support frame 110*a*.

With the above structure, a relative position of the photosensitive drum 101 and the developing sleeve 2012 is determined, and as a result a development gap G is set to a defined value.

Normally, the defined value is approximately 0.2 mm to 0.4 mm, though differing depending on the model and the type of developer.

As shown in FIG. 4, the housing 210 of the developing unit 200 has a pair of support parts 210*a* which are each in contact with a corresponding one of the bearings 202 at an opposite side to a side where the bearing 202 is in abutment with the support frame 110*a*, thereby to support the bearing 202 at the opposite side. The support part 210*a* is located such that an abutment range E and a contact range F overlap each other in the rotational axis direction of the developing sleeve 2012. The abutment range E is a range where the support frame 110*a* and the bearing 202 are in abutment with each other. The contact range F is a range where the support part 210*a* and the bearing 202 are in contact with each other.

According to the above structure, on a line of action of a pressing force applied from the bearing 202 to the support frame 110*a* resulting from forcing by the compression spring 314 functioning as a forcing member, the bearing 202 is supported by the support part 210*a*. As a result, a force tends not to occur which is for inclining the bearing 202 in the axis direction by a reactive force applied by the support frame 110*a*. This prevents deformation of the bearing 202, and ensures smooth rotation of the developing sleeve 2012.

Figure 5:
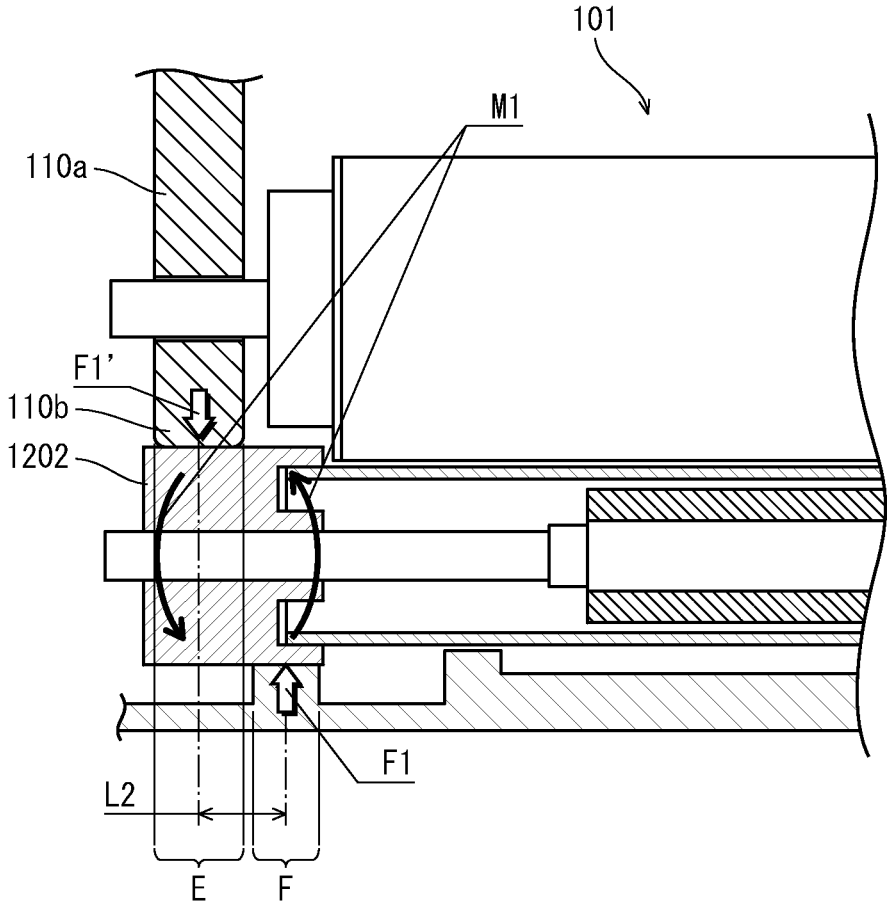
FIG. 5 is a cross-sectional view of an undesirable structure example of bearings for holding the developing unit.

If the abutment range E and the contact range F do not overlap each other at all in the rotational axis direction of the developing sleeve 2012, and specifically if the support part 210*a* is provided for example such that the abutment range E is distant from the photosensitive drum 101 and the contact range F is close to the photosensitive drum 101 as exaggeratingly shown in FIG. 5, a couple of force of F1 and F1' indicated by an arrow in FIG. 5 acts on the bearing 1202 to generate a force to rotate the bearing 1202 in counterclockwise.

Such a force causes the bearing 1202 to deform or incline in the rotational axis direction thereof, and as a result sliding friction with the developing sleeve 2012 increases. This can prevent smooth rotation of the bearing 1202.

From the above viewpoint, the abutment range E and the contact range F should be provided so as to at least partially overlap each other in the rotational axis direction of the developing sleeve 2012.

Although the above description is given on the structure for setting the development gap for the image forming unit 11K, the image forming units 11C, 11M, and 11Y of other colors also have the same structure.

As described above, the image forming unit relating to the present embodiment has the structure in which the developing sleeve 2012 is set to be longer in the rotational axis direction than the element tube 101*a* of the photosensitive drum 101, and the bearings 202 which support the developing sleeve 2012 at the both ends are brought into direct abutment with the support frames 110*a* which support the photosensitive drum 101 at the both ends, thereby to ensure a development gap.

As a result, components that exerts an influence on the accuracy of relative positioning of the photosensitive drum 101 and the developing sleeve 2012 are only four components, namely, the developing sleeve 2012, the bearings 202, the support frames 110*a*, and the photosensitive drum 101. Therefore, since a flange and a rotational shaft is not provided between the developing sleeve 2012 and the bearing 202 unlike conventional arts, it is possible to reduce an accidental error of the development gap G as small as possible.

Also, since the developing sleeve 2012 is formed just by cutting a metal tube longer, this does not cause increase in costs so much. On the other hand, since the flange and the rotational shaft, which have conventionally caused a relatively large increase in costs, become unnecessary, and bearings function also as conventional DS rollers, it is possible to significantly contribute to reduction in manufacturing costs.

<Modifications>

Although the above description has been provided on the embodiment of the present invention, the present invention is not limited to the above embodiment and may include the following modifications.

(1) In the above embodiment, the outer circumferential surface of each of the end edges 2012*a* of the developing sleeve 2012 has undergone a nickel plating process in order to improve the slidability and the abrasion resistance. Alternatively, any plating process may be performed which improves the slidability and the abrasion resistance which equal or surpass those improved by the nickel plating process. One example of such plating processes is a chrome plating process.

Also, the bearing 202 relating to the above embodiment, which is in sliding contact with the developing sleeve 2012, is a slide bearing formed from a resin. This reduces a possibility that the developing sleeve 2012 is abraded away. Accordingly, in order to improve only the slidability, mirror finishing may be performed on a surface of the bearing 202 which is in sliding contact with the developing sleeve 2012 instead of the above nickel plating process.

(2) In the above embodiment, the bearing 202 is in sliding contact with the outer circumferential surface of each of the end edges 2012*a* of the developing sleeve 2012. However, the present invention is not limited to this structure.

Figure 6:
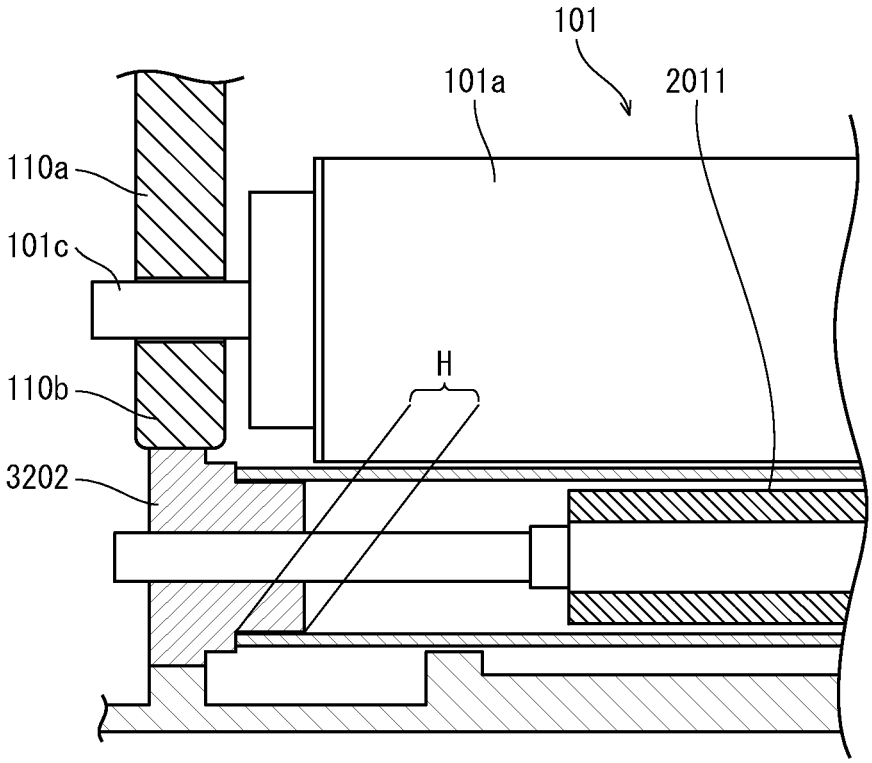
FIG. 6 is a cross-sectional view of a structure example of a developing unit relating to modification (2)

For example, it may be possible to employ a bearing 3202, as shown in FIG. 6, which is in sliding contact with an inner circumferential surface H of a corresponding one of the end edges 2012*a* of the developing sleeve 2012 to hold the developing sleeve 2012 such that the developing sleeve 2012 is rotatable.

In this case, plating processing and mirror finishing such as described above should desirably be performed on the inner circumferential surface H of the end edge 2012*a*.

(3) In the above embodiment, the bearing 202 has the boss part 202*a* at the center thereof into which the shaft 2011*a* of the magnet roller 2011 is inserted. Alternatively, as shown in FIG. 7A, a bearing 4202 which has a concave part 4202*a* instead of the boss part 202*a* may be adopted, instead of the bearing 202. Specifically, a shaft center 3110*a* of the magnet roller 2011 may be fitted into the concave part 4202*a*.

This structure makes it unnecessary to additionally provide a fixing member for fixing the shaft 2011*a*, thereby reducing manufacturing costs.

Figure 7B:
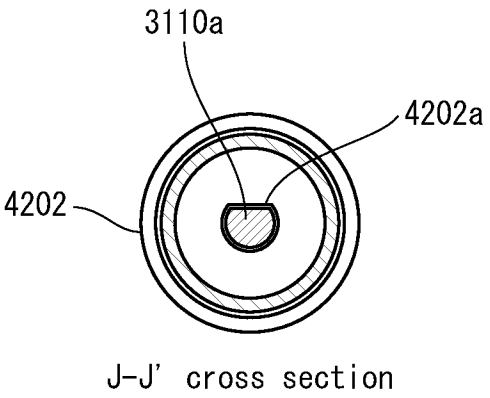
FIG. 7A and FIG. 7B are cross-sectional views each showing a structure example of a developing unit relating to modification (3)
Figure 7A:
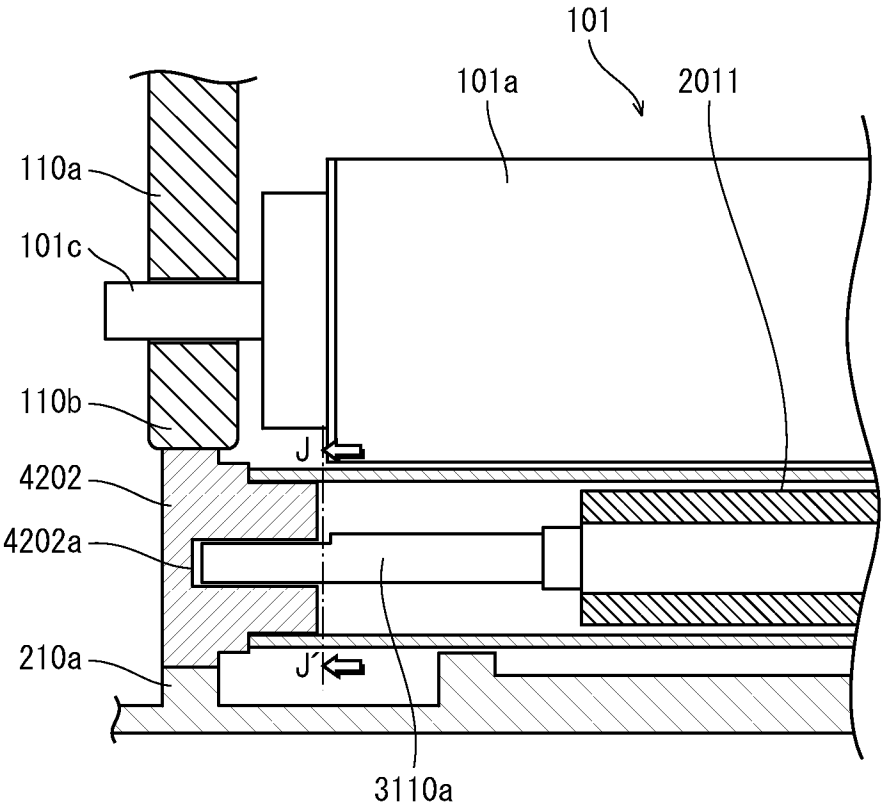

In the present modification, as shown in FIG. 7B showing a cross section of the developing unit 200 cut along a plane J-J' in FIG. 7A, the shaft center 3110*a* and the concave part 4202*a* have D-shaped cross sections while the shaft center 3110*a* are fitted into the concave part 4202*a*. This controls the magnet roller 2011 such that orientations of magnetic poles are as designed.

Figure 8B:
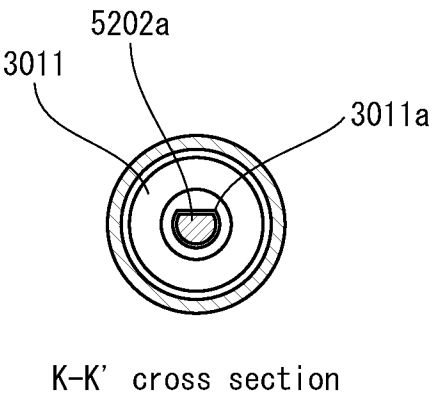
FIG. 8A and FIG. 8B are cross-sectional views each showing another structure example of the developing unit relating to modification (3)
Figure 8A:
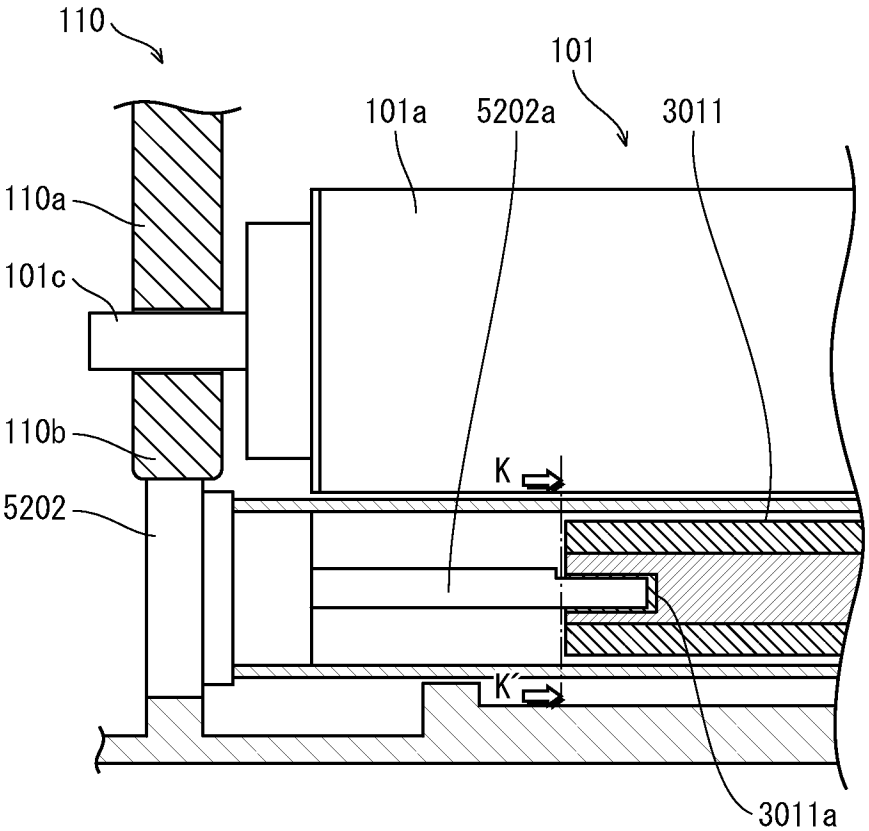

Alternatively, as shown in FIG. 8A, a bearing 5202 which has a convex part 5202*a* protruding from the center thereof inward along the rotational axis direction of the developing sleeve 2012 may be provided instead of the bearing 202, and a magnet roller 3011 which has a concave part 3011*a* to be engaged with the tip of the convex part 5202*a* may be provided instead of the magnet roller 2011.

Also in this case, as shown in FIG. 8B showing a cross section of the developing unit 200 cut along a plane K-K' in FIG. 8A, the convex part 5202*a* and the concave part 3011*a* have D-shaped cross sections. This prevents rotation of the magnet roller 3011.

Further alternatively, instead of making the convex part 5202*a* and the concave part 3011*a* to have D-shaped cross sections, the convex part 5202*a* and the concave part 3011*a*, which normally have circular cross sections, may be fixed by an adhesive to prevent rotation of the magnet roller 3011. This structure is of course applicable to the developing unit 200 shown in FIG. 7A and FIG. 7B in a similar way.

(4) In the above embodiment, the boss external gear 208 is externally fitted into one of the ends of the developing sleeve 2012, and is fixed by the screw 209. However, the present invention is not limited to this structure.

In the case where the developing sleeve 2012 has a thin thickness, the structure of fixing the boss external gear 208 by the screw 209 as shown in FIG. 4 is insufficient in terms of an engagement allowance of the screw 209. As a result, there is a possibility that a high durability cannot be achieved.

In view of this, the present modification describes a structure in which a boss external gear 1208 is retained by the developing sleeve 2012 without using any screw.

Figure 9A:
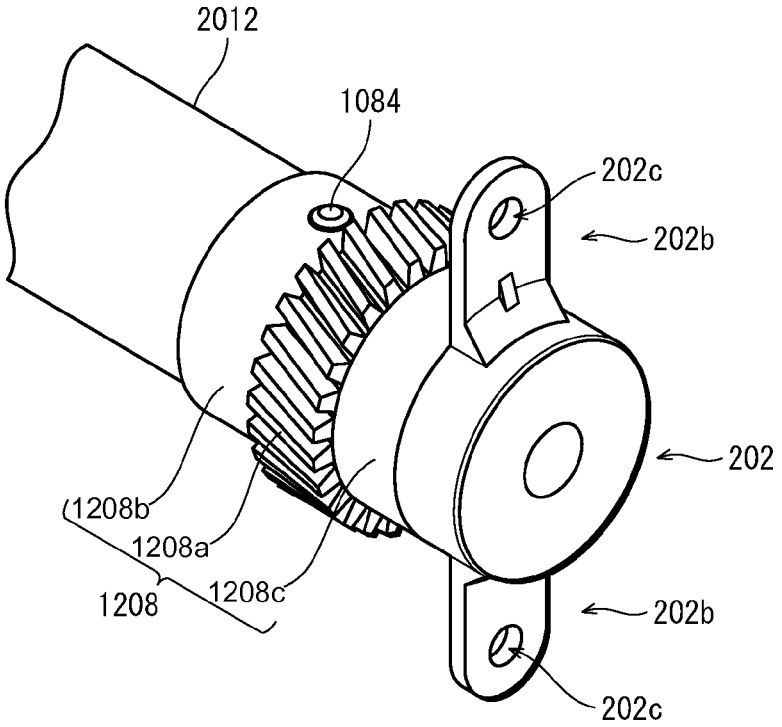
FIG. 9A is a perspective view of one of ends of the developing sleeve of a developing unit relating to modification example (4) to which a boss external gear is attached.

FIG. 9A is a perspective view of an example of such a retaining structure. FIG. 9A shows only one of the ends of the developing sleeve 2012 to which the boss external gear 1208 is attached.

Figure 9B:
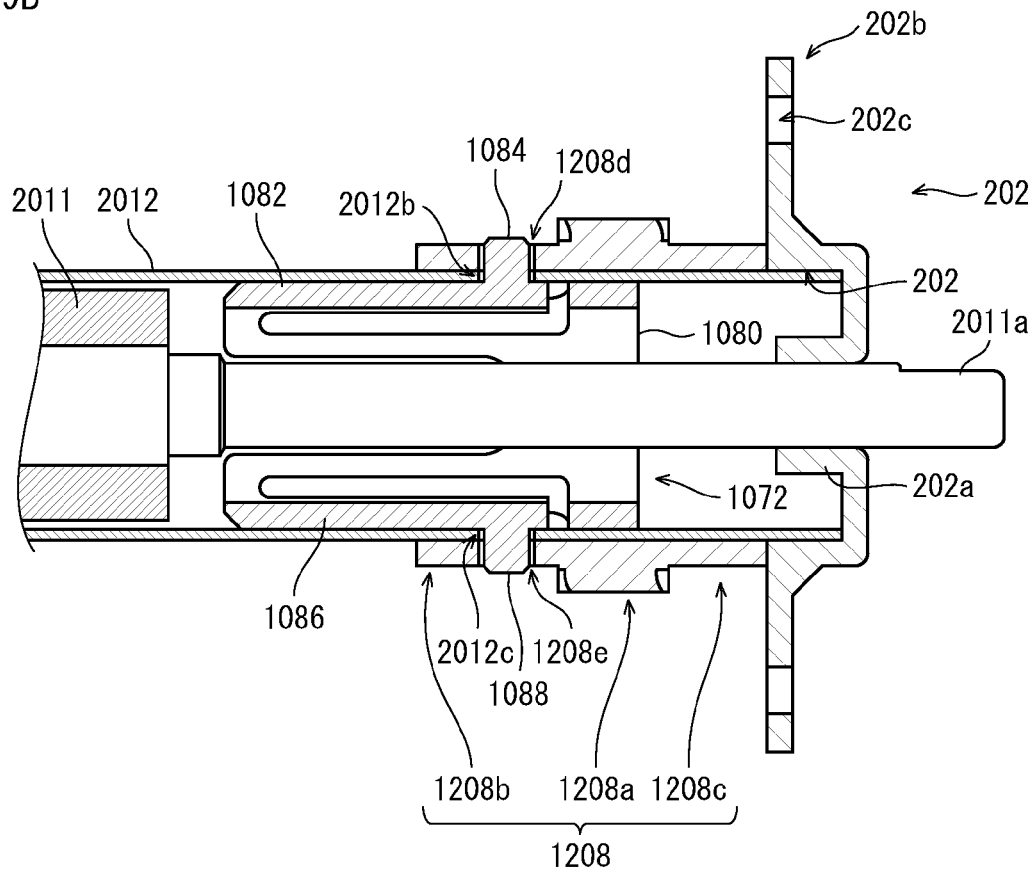
FIG. 9B is a longitudinal sectional view of the end of the developing sleeve shown in FIG. 9A.
Figure 10:
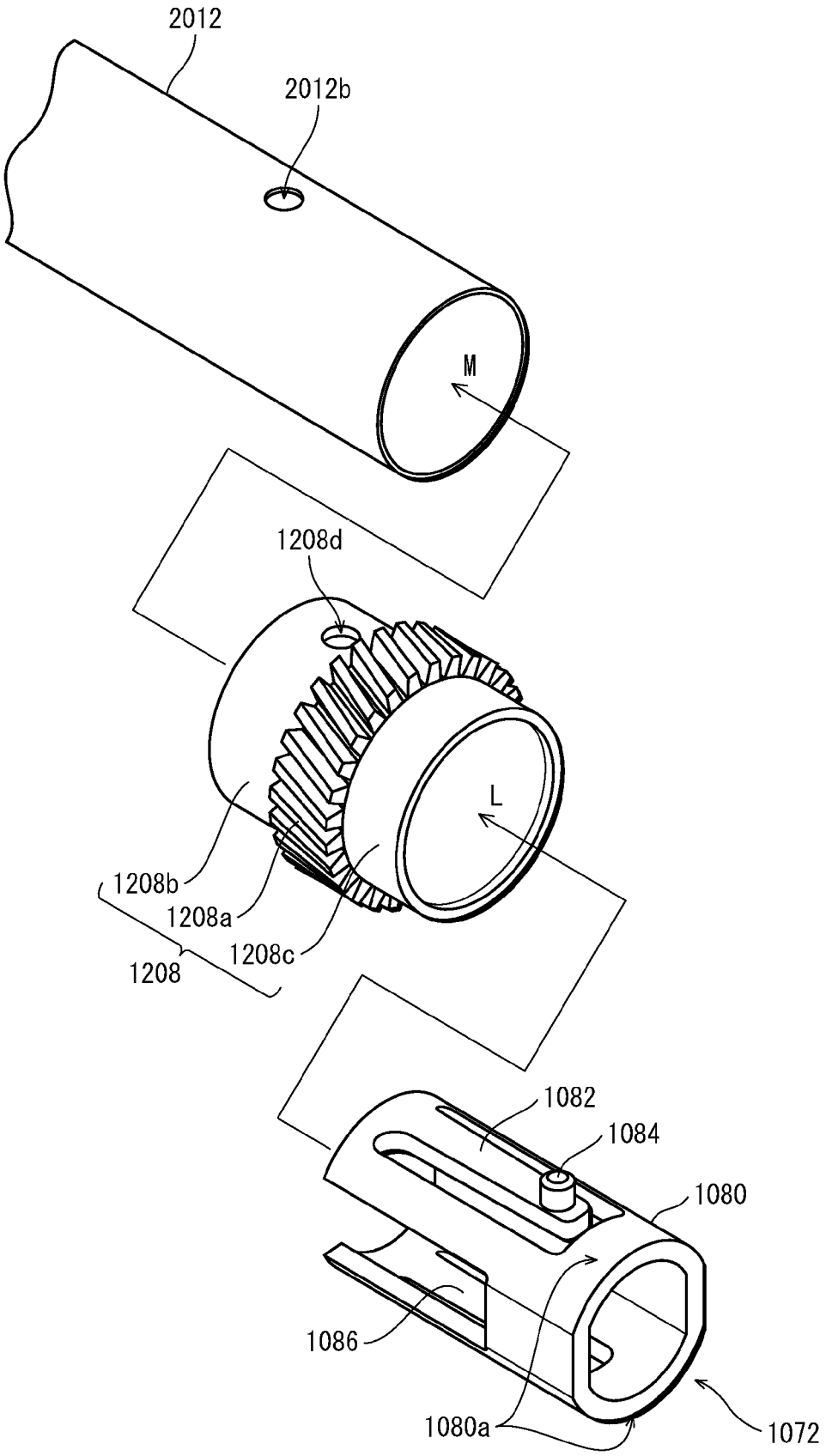
FIG. 10 is an exploded perspective view of the developing sleeve, the boss external gear, and a retaining member of the developing unit relating to modification example (4)

Also, FIG. 9B is a longitudinal sectional view of the end of the developing sleeve 2012 shown in FIG. 9A, and FIG. 10 is an exploded perspective view of the developing sleeve 2012, the boss external gear 1208, and a retaining member 1072.

In FIG. 9A, the shaft 2011*a* of the magnet roller 2011, which protrudes from the bearing 202 outward in the shaft center direction (FIG. 9B), is omitted. Also, in FIG. 9A, FIG. 9B, and FIG. 10, components which are the same or substantially the same as those in the above embodiment have the same reference numerals, and description thereof is omitted.

The boss external gear 1208 has a gear part 1208*a*, and a first boss part 1208*b* and a second boss part 1208*c* which extend from the gear part 1208*a* in opposite axis directions.

The gear part 1208*a* is a helical gear. The first boss part 1208*b* has an engaging hole 1208*d* opened therein which is a through-hole penetrating in a radial direction of the first boss part 1208*b*.

The first boss part 1208*b* also has another engaging hole 1208*e* opened therein which is offset by 180 degrees from the engaging hole 1208*d* in a circumferential direction of the first boss part 1208*b* (FIG. 9B).

Furthermore, the developing sleeve 2012 has a through-hole 2012*b* opened therein penetrating in a radial direction of the developing sleeve 2012, as shown in FIG. 10. The developing sleeve 2012 also has another through-hole 2012*c* opened therein which is offset by 180 degrees from the through-hole 2012*b* in the circumferential direction of the developing sleeve 2012 (FIG. 9B).

The through-holes 2012*b* and 2012*c* and the engaging holes 1208*d* and 1208*e* are equal to each other in diameter.

The retaining member 1072 is formed from a resin, and is basically a tubular member (a cylindrical member in the present modification) which is partially cut.

As shown in FIG. 10, the retaining member 1072 is a tubular member which has a longitudinal U-shaped slit to form an elongated rectangular tongue part 1082 therein. In other words, the tongue part 1082 is an inner part of the U-shaped slit of the retaining member 1072.

The tongue part 1082, a tongue part 1086 which is describe later, and part of the retaining member 1072 other than retaining protrusions 1084 and 1088 which are described later are collectively referred to as a main part 1080.

That is, the tongue part 1082 is integrally formed together with the main part 1080, and has a part extending from the main part 1080 in parallel to the axis of the tubular member. The tongue part 1082 has a flexibility at the extending part in the radial direction of the tubular member. Specifically, the tongue part 1082 deforms from the base end to the tip end in the radial direction.

The tongue part 1082 has, at the tip thereof, a retaining protrusion 1084 which is tubular (cylindrical in the present modification).

The retaining member 1072 also has another tongue part 1086 which is offset by 180 degrees from the tongue part 1082 in a circumferential direction of the retaining member 1072. The tongue part 1086 is similar to the tongue part 1082.

In other words, the tongue part 1086 has, at the tip thereof, a retaining protrusion 1088 which is similar to the retaining protrusion 1084 (FIG. 9B).

As shown in FIG. 10, the main part 1080 has a cylindrical surface 1080*a* whose outer diameter is set such that the main part 1080 is smoothly inserted into the developing sleeve 2012 without backlash.

The main part 1080, which includes the tongue parts 1082 and 1086 and the retaining protrusions 1084 and 1088, is inserted into the developing sleeve 2012.

The following describes a procedure of assembling the developing sleeve 2012, the boss external gear 1208, and the retaining member 1072, which have the above descried structure.

Firstly, the boss external gear 1208 is externally fitted into the developing sleeve 2012 in a direction indicated by an arrow M shown in FIG. 10. Then, relative position adjustment of the boss external gear 1208 and the developing sleeve 2012 is performed such that the through-holes 2012*b* and 2012*c* are communicated with the engaging holes 1208*d* and 1208*e*, respectively (FIG. 9B).

A communication position where the through-hole 2012*b* is communicated with the engaging hole 1208*d* and a communication position where the through-hole 2012*c* is communicated with the engaging hole 1208*e* (FIG. 9B) are defined positions between the boss external gear 1208 and the developing sleeve 2012.

In other words, the through-holes 2012*b* and 2012*c* are formed so as to overlap the engaging holes 1208*d* and 1208*e*, respectively such that the boss external gear 1208 is attached to the developing sleeve 2012 at the defined positions.

The defined positions need to be positioned such that the developing sleeve 2012 has a fitting space for the bearing 202 which is described later at the end thereof while the boss external gear 1208 is attached to the developing sleeve 2012, and also such that the bearing 202 and the boss external gear 1208 have no unnecessary gap therebetween while the bearing 202 is fitted into the developing sleeve 2012.

After the above position adjustment, the retaining member 1072 is inserted into the developing sleeve 2012 in a direction indicated by an arrow L shown in FIG. 10, into which the boss external gear 1208 is externally fitted.

Here, the retaining protrusions 1084 and 1088 are forced toward each other, in other words, the tongue parts 1082 and 1086 are elastically deformed inward in the radial direction of the retaining member 1072, thereby sliding the retaining member 1072 into the developing sleeve 2012.

Then, the retaining member 1072 is further slid deep into the developing sleeve 2012 until the retaining protrusions 1084 and 1088 reach the communication position between the through-hole 2012*b* and the engaging hole 1208*d* and the communication position between the through-hole 2012*c* and the engaging hole 1208*e*, respectively.

When the retaining protrusions 1084 and 1088 reach the communication positions of the through-holes 2012*b* and 2012*c*, respectively, restoring forces of the tongue parts 1082 and 1086 make the retaining protrusions 1084 and 1088 to fit into the engaging holes 1208*d* and 1208*e* via the through-holes 2012*b* and 2012*c*, which are respectively communicated with the engaging holes 1208*d* and 1208*e*, respectively.

As a result, the retaining member 1072 inserted into the developing sleeve 2012 makes the boss external gear 1208 to be retained by the developing sleeve 2012, as shown in FIG. 9B.

According to the above structure such as have been described, it is possible to retain the boss external gear 1208 by the developing sleeve 2012 only with a simple operation of inserting the retaining member 1072 into the developing sleeve 2012 while the boss external gear 1208 is positioned relative to the developing sleeve 2012.

Also, the retaining protrusions 1084 and 1088 enter, from the inside of the developing sleeve 2012, the engaging holes 1208*d* and 1208*e* via the through-holes 2012*b* and 2012*c*, which are respectively communicated with the engaging holes 1208*d* and 1208*e*, respectively. For this reason, the developing sleeve 2012 should desirably have no protrusion at an inner circumference thereof.

In the example shown in FIG. 9B, chamfered surfaces of respective ends of the retaining protrusions 1084 and 1088 are exposed from respective opening edges of the engaging holes 1208*d* and 1208*e*, respectively. Alternatively, height of the retaining protrusions 1084 and 1088 may be set such that respective edge surfaces of the retaining protrusions 1084 and 1088 are equal in height to the respective opening edges of the engaging holes 1208*d* and 1208*e*, respectively.

In this way, one of the ends of the developing sleeve 2012 retains the boss external gear 1208, and the ends of the developing sleeve 2012 are pivotally supported by the bearing 202 such that the developing sleeve 2012 is rotatable, in the same manner as the developing unit 200 relating to the above embodiment.

A rotational power of the boss external gear 1208 is transmitted to the developing sleeve 2012 via the retaining protrusions 1084 and 1088.

The present modification employs the structure in which a retaining protrusion is fitted into a hole formed in each of the boss external gear and the developing sleeve so as to transmit power. Accordingly, even in the case where the developing sleeve has a thin thickness, it is possible to keep transmission of a rotational power for a longer time period compared with the case where the boss external gear is fixed by a screw, thereby improving the durability.

(5) In the above embodiment, a metal piece which is not illustrated is brought into sliding contact with the outer circumferential surface of the developing sleeve 2012 so as to apply a developing bias voltage to the developing sleeve 2012 via the metal piece. However, the present invention is not limited to this structure.

Alternatively, it may be possible to use a member which is similar to the retaining member 1072 (FIG. 10) relating to the above modification (4), and bring a metal member into abutment with the inner circumferential surface of the developing sleeve 2012 to apply a developing bias voltage to the developing sleeve 2012.

FIG. 11A to FIG. 13 each show a structure of a developing roller having such a structure.

In FIG. 11A to FIG. 13, components which are the same or substantially the same as those in the above embodiment have the same reference numerals, and description thereof is given only as necessary.

Figure 11A:
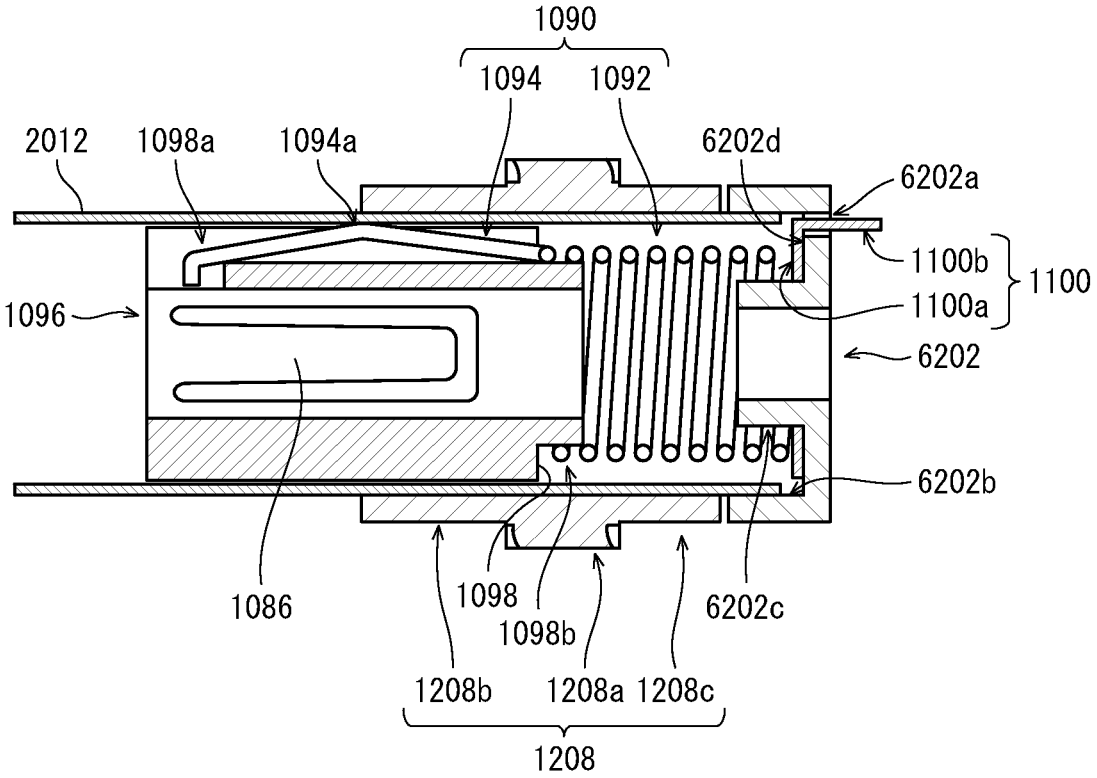
FIG. 11A is a longitudinal sectional view of one of ends of a developing unit relating to modification example (5) to which a boss external gear is attached.

FIG. 11A is a longitudinal sectional view of one of the ends of the developing sleeve 2012 to which the boss external gear 1208 is attached.

While FIG. 9B relating to the above modification (4) shows the end of the developing sleeve 2012 which is cut along a plane including the retaining protrusions 1084 and 1088 of the retaining member 1072, FIG. 11A shows the end of the developing sleeve 2012 cut along a plane perpendicular to the plane including the retaining protrusions 1084 and 1088.

Also, the magnet roller 2011 and the shaft 2011*a* (FIG. 9B) are omitted in FIG. 11A.

Figure 11B:
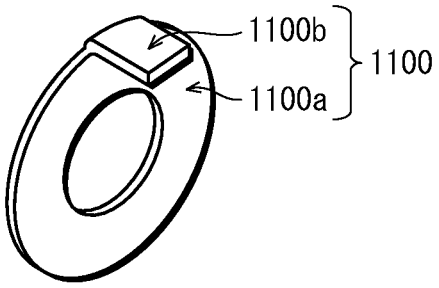
FIG. 11B is a perspective view of a terminal member of the developing sleeve.

FIG. 11B is a perspective view of a terminal member 1100 which is described later.

Figure 12:
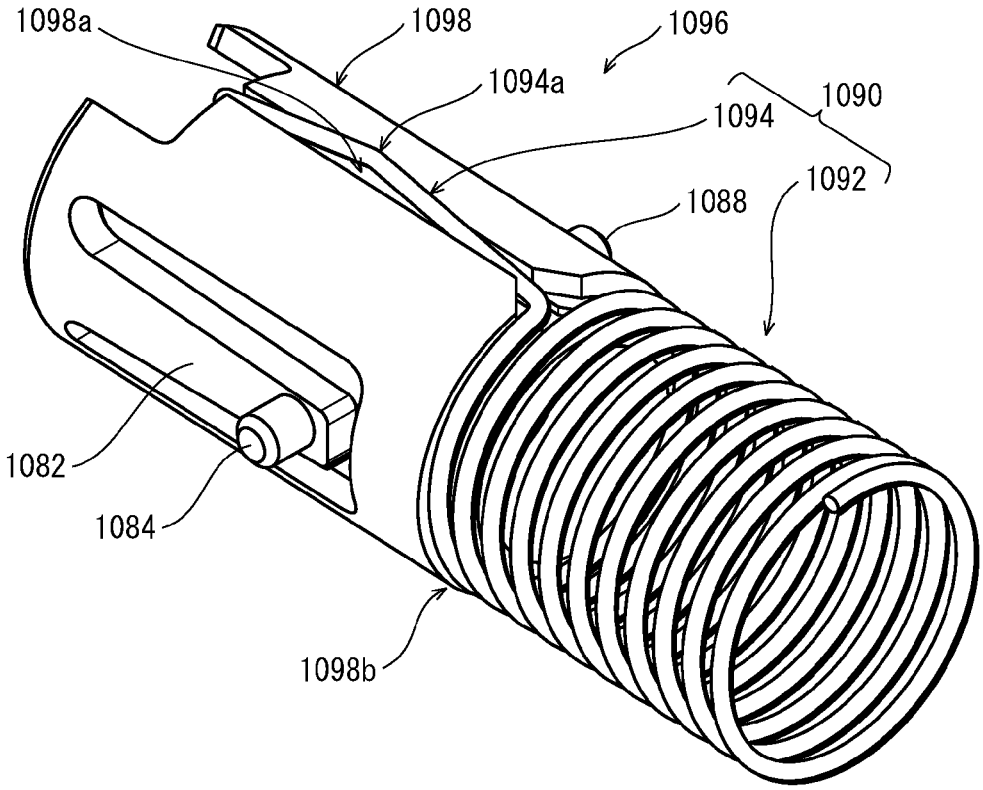
FIG. 12 is a perspective view of a retaining member relating to modification example (5) to which a voltage applying member which is described later is attached.
Figure 13:
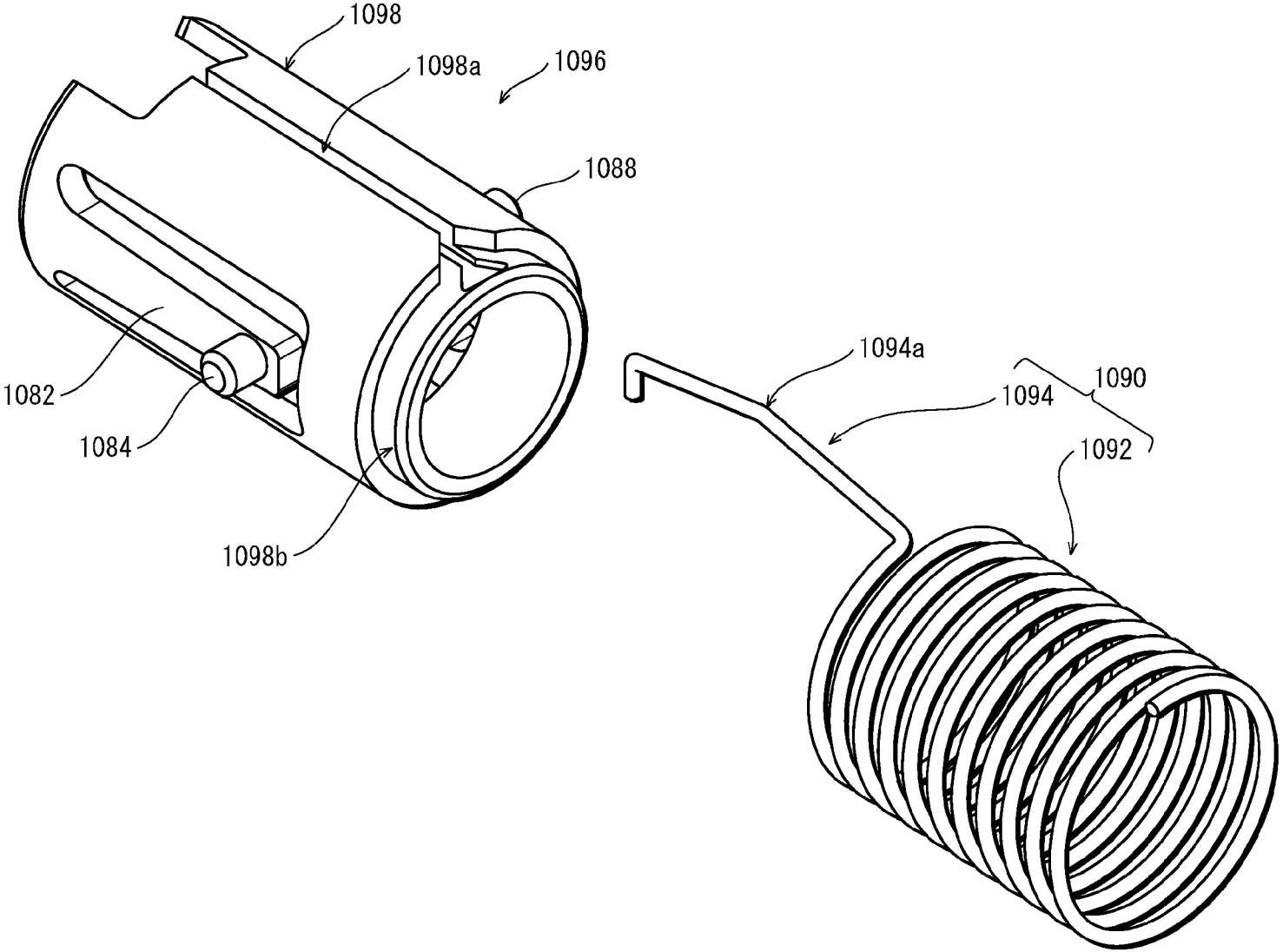
FIG. 13 is an exploded perspective view of the retaining member and the voltage applying member relating to modification example (5)

FIG. 12 is a perspective view of a retaining member 1096 to which a voltage applying member 1090 which is described later is attached. FIG. 13 is an exploded perspective view of the retaining member 1096 and the voltage applying member 1090.

As shown in FIG. 13, the voltage applying member 1090 is an element wire having conductivity and elasticity (for example, a metal wire such as a stainless steel wire) which is bent. The voltage applying member 1090 has a compressed coil spring part (hereinafter, referred to just as a coil spring part) 1092 and an extending part 1094 which is formed from an element wire extending from the coil spring part 1092.

The extending part 1094 extends in a direction parallel to the axis of the coil spring part 1092, and is bent to have a mound shape midway thereof so as to protrude outward in a direction parallel to the radial direction of the coil spring part 1092.

One of ends of a main part 1098 of the retaining member 1096 has a small diameter part 1098*b* into which one of ends of the coil spring part 1092, namely, the end of the coil spring part 1092 from which the extending part 1094 extends is to be fitted.

Also, the main part 1098 has, at an outer circumferential surface thereof, a groove 1098*a* extending in a direction parallel to an axis direction of the main part 1098.

As shown in FIG. 12, the voltage applying member 1090 is assembled with the retaining member 1096 by embedding part of the extending part 1094 into the groove 1098*a* and fitting the end of the coil spring part 1092 into the small diameter part 1098*b*.

As shown in FIG. 11A, the assembly of the retaining member 1096 and the voltage applying member 1090 (FIG. 12) is inserted into the developing sleeve 2012 into which the boss external gear 1208 is externally fitted until the retaining protrusions 1084 and 1088 (FIG. 12) are inserted into the engaging holes 1208*d* and 1208*e* via the through-holes 2012*c* and 2012*c*, respectively (the through-hole 2012*c* and the engaging hole 1208*e* are not illustrated in FIG. 11A).

After the assembly is inserted, the extending part 1094, which is bent to have a mound shape, is pressed by the inner circumferential surface of the developing sleeve 2012 thereby to elastically deform to increase an opening angle of the mound shape. A restoring force of the extending part 1094 brings a tip 1094*a* thereof into abutment (pressure-contact) with the inner circumferential surface of the developing sleeve 2012. This establishes an electrical connection between the voltage applying member 1090 and the developing sleeve 2012.

As shown in FIG. 11A, the ends of the developing sleeve 2012 are pivotally supported by bearings 6202 which have substantially the same structure of the bearings 202 relating to the above embodiment such that the developing sleeve is rotatable.

Specifically, the bearings 6202 have the same structure with the bearings 202, excepting that the bearings 6202 each have a drawing hole 6202*a* opened therein which is described later.

In other words, the bearing 6202 is double cylindrical, and specifically has a circular cylindrical portion 6202*b* positioned outward and a circular cylindrical portion 6202*c* positioned inward.

A bottom part 6202*d* which is positioned between the circular cylindrical parts 6202*b* and 6202*c* has provided thereon the terminal member 1100 formed from a metal material such as a phosphor copper and a stainless steel.

The terminal member 1100 has, as shown in FIG. 11B, a plate part 1100*a* which is annular and a rectangular part 1100*b* which extends from an outer circumference of the plate part 1100*a* so as to be perpendicular to a main surface of the plate part 1100*a*.

The plate part 1100*a* of the terminal member 1100 is provided in the bottom part 6202*d* of the bearing 6202. The rectangular part 1100*b* is drawn via the drawing hole 6202*a* opened in the bottom part 6202*d*, and is partially exposed outside from the bearing 6202.

The coil spring part 1092 of the voltage applying member 1090 is inserted in compression between the main part 1098 of the retaining member 1096 and the plate part 1100*a* of the terminal member 1100. A restoring force of the coil spring part 1092 always keeps the plate part 1100*a* in contact with the end of the coil spring part 1092 at the side of the plate part 1100*a*.

This establishes an electrical connection between the coil spring part 1092 and the plate part 1100*a* (the terminal member 1100).

According to the above structure, when a voltage is applied to a part of the rectangular part 1100*b* of the terminal member 1100 which is exposed outside from the bearing 6202, a developing bias voltage is applied to the developing sleeve 2012 via the plate part 1100*a*, the coil spring part 1092, and the extending part 1094.

The extending part 1094 of the voltage applying member 1090 is partially embedded into the groove 1098*a* of the retaining member 1096. Accordingly, when the developing sleeve 2012 rotates, the voltage applying member 1090 rotates together with the retaining member 1096.

In this case, the end of the coil spring part 1092 at the side of the plate part 1100*a* is brought into sliding contact with the plate part 1100*a* which remains still.

Accordingly, in order to increase an area of the coil spring part 1092 which is in sliding contact with the plate part 1100*a*, the end of the coil spring part 1092 at the side of the plate part 1100*a* should desirably be a closed-end spring which has undergo grinding (closed-end (no-grinding) is shown here as an example).

Also, the coil spring part 1092 should desirably be wired in a direction, such that the diameter of the coil spring 1092 is reduced by action of sliding friction generated between the plate part 1100*a* and the voltage applying member 1090 during rotation of the voltage applying member 1090.

According to this structure, since the voltage applying member 1090 is in contact with the inner circumferential surface of the developing sleeve 2012, the total length of the developing sleeve 2012 is reduced compared with the case where the voltage applying member 1090 is brought into contact with the outer circumferential surface of the developing sleeve 2012. Therefore, it is possible to further reduce the size of the developing device.

That is, in the case where a rectangular metal piece is brought into contact with the outer circumferential surface of the developing sleeve 2012 such as described in the above embodiment, the metal piece needs to be provided outward in the longitudinal direction of the photosensitive drum facing the developing sleeve 2012. This causes an inconvenience such as scattering of abrasion powder due to abrasion of the developing sleeve 2012 or abrasion of the metal piece. However, in the case where the metal piece is provided on the inner circumferential surface of the developing sleeve 2012, such an inconvenience does not occur. Therefore, the developing device is reduced in size.

Note that, in the present modification, in the case where a developing bias voltage is applied to the end of the developing sleeve 2012 to which the boss external gear 1208 is not attached, the retaining member 1102 does not need to have a function of retaining the boss external gear 1208, and functions just as a holding member for holding the voltage applying member 1090.

(6) Also, the retaining member 1072 relating to the above modification (4) may have the following structure as a modification.

Figure 14A:
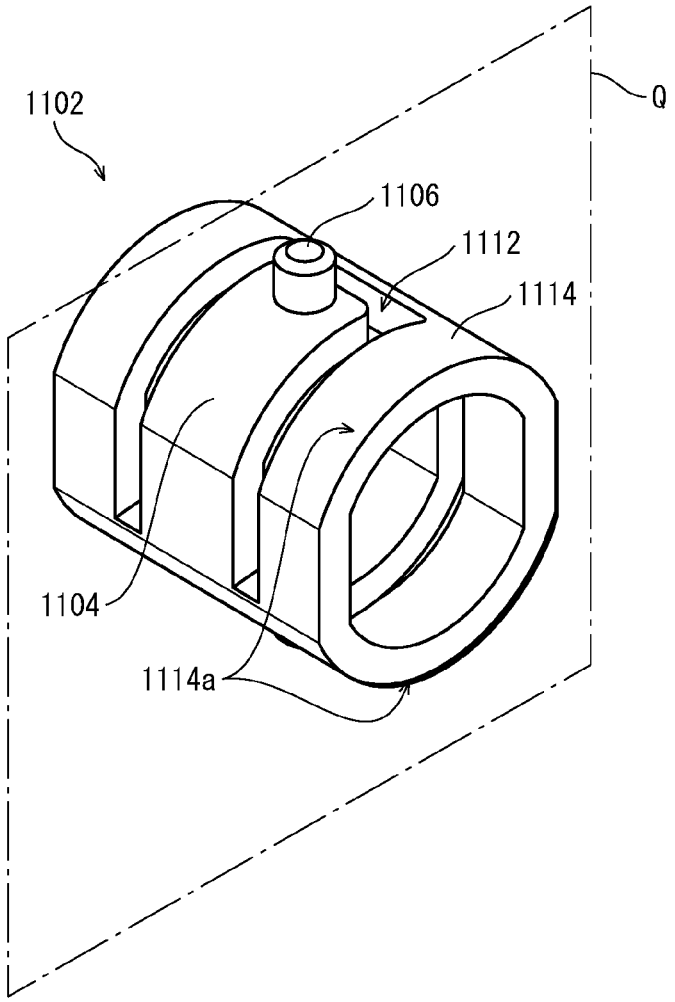
FIG. 14A is a perspective view of a retaining member relating to modification example (6)

FIG. 14A is a perspective view of a retaining member 1102 relating to the present modification.

The retaining member 1102 is formed from a resin, and is basically a tubular member (a cylindrical member in the present modification) which is partially cut, like the retaining member 1072 (FIG. 10).

While the retaining member 1072 has the tongue parts 1082 and 1086 in the longitudinal direction (length direction) of the tubular member, the retaining member 1102 has a tongue part 1104 along a circumferential direction thereof as shown in FIG. 14A.

The tongue part 1104 is formed by a U-shaped slit 1112 formed in the tubular member.

The tongue part 1104 has, at the tip thereof, a retaining protrusion 1106 which is tubular (cylindrical in the present modification).

In the present modification, the tongue part 1104, a tongue part 1108 which is described later, and part of the retaining member 1102 other than the retaining protrusion 1106 and a retaining protrusion 1110 which is described later are collectively referred to as a main part 1114, like in the above embodiment.

That is, the tongue part 1104 is integrally formed together with the main part 1114, and has an extending part extending from the main part 1114 toward the circumferential direction of the tubular member. The tongue part 1104 has a flexibility at least at the extending part in the radial direction of the tubular member. Specifically, the tongue part 1104 deforms at least from the base end to the tip end inward the tubular member.

Figure 14B:
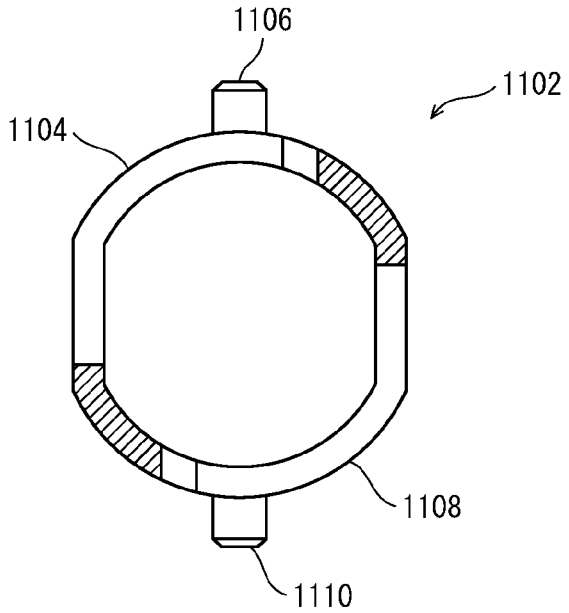
FIG. 14B is a transverse sectional view of the retaining member cut along a plane Q in FIG. 14A.
Figure 15:
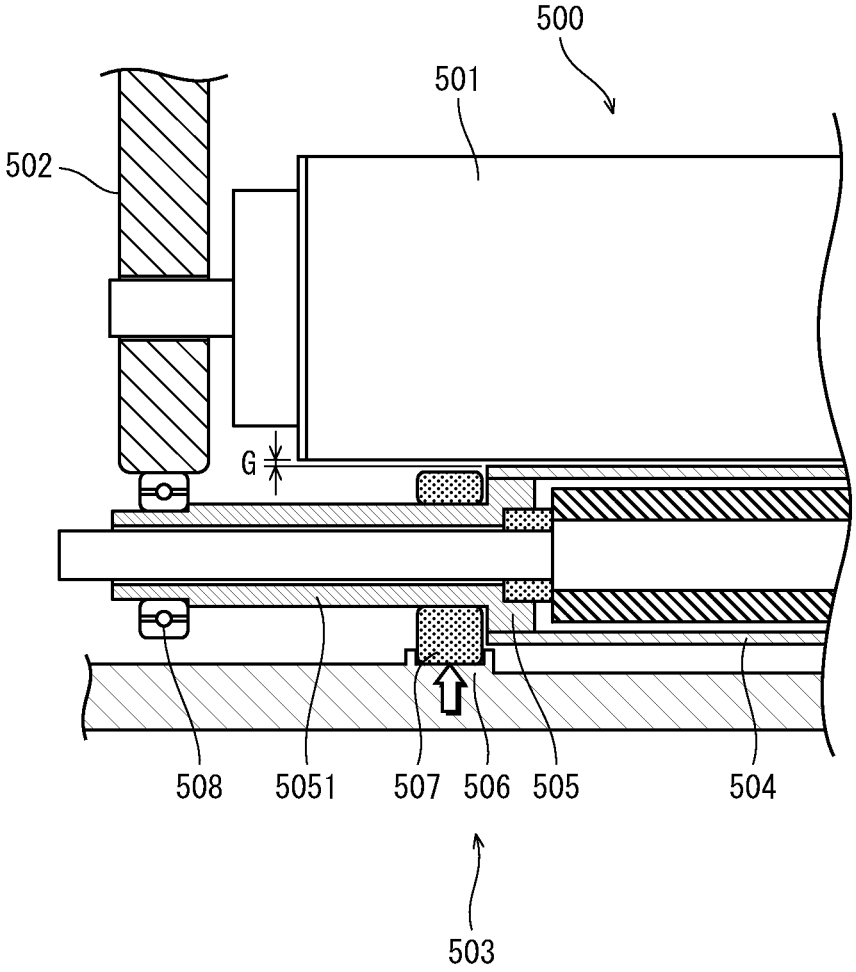
FIG. 15 Prior Art
FIG. 15 is a cross-sectional view of structure of a conventional developing unit.

FIG. 14B is a transverse sectional view of the retaining member 1102 cut along a plane Q in FIG. 14A.

As shown in FIG. 14B, the retaining member 1102 also has another tongue part 1108 at an opposite position of the tongue part 1104. The tongue part 1108 is similar to the tongue part 1104, and has a retaining protrusion 1110 at the tip thereof.

Returning to FIG. 14A, the main part 1114 has a cylindrical surface 1114*a* whose outer diameter is set such that the main part 1114 is smoothly inserted into the developing sleeve 2012 (FIG. 9A to FIG. 10) without backlash. The main part 1114, which includes the tongue parts 1104 and 1108 and the retaining protrusions 1106 and 1110, is inserted into the developing sleeve 2012. The main part 1114 functions as an insert which is to be inserted into the developing sleeve 2012 like in the modification (4).

A procedure of assembling the developing sleeve 2012, the boss external gear 1208 (FIG. 10), and the retaining member 1102 is the same as that described in the modification (4), and accordingly description thereof is omitted here.

(7) In the modifications (4) to (6), an engaging hole to be opened in the boss external gear is not limited to a through-hole such as shown in the above embodiment, and may be a blind hole. Any type of engaging hole may be used as long as the engaging hole is formed in an inner circumferential surface of a shaft hole of the boss external gear so as to be engaged with the retaining protrusion.

(8) In the above embodiment and the modifications (4) to (6), the boss external gear is used as a gear to be retained in the developing sleeve to transmit a driving force. Alternatively, an external gear without a boss may be used, and in this case, a spur gear may be used instead of a helical gear.

(9) In the modifications (4) to (6), two retaining protrusions are used for the developing sleeve to retain the boss external gear. Alternatively, the number of the retaining protrusions may be one. Further alternatively, three or more retaining protrusions may be used. In the case where a plurality of retaining protrusions are used, the retaining protrusions should desirably be provided at regular intervals in the circumferential direction of the boss external gear and the developing sleeve.

(10) In the modifications (4) to (6), a tongue part is used as a forcing member for forcing the retaining protrusions outward in the radial direction of the developing sleeve. Alternatively, a compression coil spring may be used as such a forcing member.

For example, the following structure may be employed in which a compression coil spring is embedded into a concave part formed in an outer circumference of a cylindrical insert so as to be concave in a radial direction of the insert, and a columnar retaining protrusion is provided on the upper end of the compression coil spring such that the retaining protrusion is partially exposed from the outer circumference of the insert.

In this case, an elastic member such as a sponge may be used instead of the compression coil spring.

(11) The above embodiment has described an example of the developing unit 200 in which slide bearings are used as bearings for holding the end edges 2012*a* of the developing sleeve 2012. Alternatively, since ball bearings which have a high dimensional accuracy and are comparatively inexpensive are manufactured in recent years, such rolling bears may be used instead in some cases.

(12) In the above embodiment, a development gap is ensured by forcing the developing unit 200 toward the photosensitive unit 100. Alternatively, a development gap can be ensured by forcing the photosensitive unit 100 toward the developing unit 200 in some cases. In other words, any structure may be employed as long as the developing unit 200 is relatively forced toward the photosensitive unit 100.

(13) In the above embodiment, the developing unit 200 uses two-component developer. Alternatively, the present invention is applicable to any developing unit which ensures a development gap and employs a developing system using single component magnetic toner.

(14) The above embodiment has described a tandem type color printer. However, the present invention is not limited to this, and may for example be a monochrome printer, or a multifunction machine having additional functions of a copy machine and facsimile, or the like.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus that supplies toner to an electrostatic latent image formed on a circumferential surface of a photosensitive rotating member to develop the electrostatic latent image, the image forming apparatus comprising:

a photosensitive unit that includes the photosensitive rotating member and a pair of support frames, the support frames rotatably supporting the photosensitive rotating member at axial ends thereof;

a developing unit that includes a developing sleeve and a pair of bearings, the developing sleeve being longer in a rotational axis direction thereof than an element tube of the photosensitive rotating member in a rotational axis direction thereof, the bearings being provided outward from axial ends of the element tube and rotatably holding the developing sleeve at edges of axial ends thereof;

a forcing member that relatively forces the developing unit toward the photosensitive unit to bring each of the bearings into abutment with an abutment part of a corresponding one of the support frames, such that a gap between the developing sleeve and the photosensitive rotating member is maintained at a predetermined value;

a voltage applying member that is inserted into the developing sleeve to be in contact with an inner circumferential surface of the developing sleeve to apply a voltage to the developing sleeve; and a retaining member that retains the voltage applying member inside the developing sleeve, wherein the voltage applying member comprises:

a coil part that is formed from a helically-wound element wire having conductivity and elasticity; and an extending part that is continuous with one of ends of the coil part and extends along a central axis of the coil part, wherein the retaining member retains the voltage applying member while pressing the other end of the coil part toward a part of one of the bearings which faces an opening provided at one of the ends of the developing sleeve and bringing the extending part into elastic abutment with the inner circumferential surface of the developing sleeve, and the bearing has a conductive member provided at the part thereof which is in abutment with the other end of the coil part, and wherein a developing bias voltage is applied to the developing sleeve via the conductive member and the voltage applying member.

2. The image forming apparatus of claim 1, wherein the bearings are each a slide bearing that is brought into sliding contact with an outer circumference surface or an inner circumference surface of a corresponding one of the edges of the axial ends of the developing sleeve, thereby rotatably holding the developing sleeve, and the surfaces of the edges of the ends of the developing sleeve that are brought into sliding contact with the bearings have undergone surface processing for improving slidability or abrasion resistance.

3. The image forming apparatus of claim 2, wherein the surface processing is plating processing.

4. The image forming apparatus of claim 2, wherein the surface processing is mirror finishing.

5. The image forming apparatus of claim 1, wherein the developing unit further includes a magnet roller that is coaxially inserted into the developing sleeve, and the bearings each have a holding part that holds a corresponding one of axial ends of the magnet roller.

6. The image forming apparatus of claim 5, wherein the holding part is a through-hole or a concave part, the magnet roller has a shaft, and the axial end of the shaft of the magnet roller is fit into the holding part.

7. The image forming apparatus of claim 5, wherein the holding part is a convex part, and the magnet roller has a concave part at the axial end thereof into which the convex part is fitted.

8. The image forming apparatus of claim 1, wherein the developing unit has a pair of support parts supporting a corresponding one of the bearings by being brought into contact with the bearing at a side thereof opposite to the abutment part of the support frame, and the support part is provided such that when seen in a direction in which the bearing is forced toward the support frame, an abutment range between the abutment part of the support frame and the bearing at least partially overlaps a contact range between the bearing and the support part.

9. The image forming apparatus of claim 1, wherein the developing sleeve is driven to rotate such that, at a position at which the developing sleeve and the photosensitive rotating member oppose each other, a rotational direction of the developing sleeve is counter to a rotational direction of the photosensitive rotating member.

10. The image forming apparatus of claim 1, wherein the developing unit further includes an external gear that is externally fit onto the developing sleeve, and the developing sleeve receives a driving force from a driving source via the external gear.

11. The image forming apparatus of claim 1, wherein the extending part has a bent part that is bent outward in a radial direction of the developing sleeve to have a mound shape, and a tip of the bent part is in abutment with the inner circumferential surface of the developing sleeve.

12. An image forming unit that supplies toner to an electrostatic latent image formed on a circumferential surface of a photosensitive rotating member to develop the electrostatic latent image, the image forming unit comprising:

a photosensitive unit that includes the photosensitive rotating member and a pair of support frames, the support frames rotatably supporting the photosensitive rotating member at axial ends thereof;

a developing unit that includes a developing sleeve and a pair of bearings, the developing sleeve being longer in a rotational axis direction thereof than an element tube of the photosensitive rotating member in a rotational axis direction thereof, the bearings being provided outward from axial ends of the element tube and rotatably holding the developing sleeve at edges of axial ends thereof;

a support member that supports the developing unit such that the developing unit is swingable with respect to the photosensitive unit;

a forcing member that relatively forces the developing unit toward the photosensitive unit to bring each of the bearings into abutment with an abutment part of a corresponding one of the support frames, such that a gap between the developing sleeve and the photosensitive rotating member is maintained at a predetermined value;

a voltage applying member that is inserted into the developing sleeve to be in contact with an inner circumferential surface of the developing sleeve to apply a voltage to the developing sleeve; and a retaining member that retains the voltage applying member inside the developing sleeve, wherein the voltage applying member comprises:

a coil part that is formed from a helically-wound element wire having conductivity and elasticity; and an extending part that is continuous with one of ends of the coil part and extends along a central axis of the coil part, wherein the retaining member retains the voltage applying member while pressing the other end of the coil part toward a part of one of the bearings which faces an opening provided at one of the ends of the developing sleeve and bringing the extending part into elastic abutment with the inner circumferential surface of the developing sleeve, and the bearing has a conductive member provided at the part thereof which is in abutment with the other end of the coil part, and wherein a developing bias voltage is applied to the developing sleeve via the conductive member and the voltage applying member.

13. A developing unit that includes a developing sleeve, and is relatively forced toward a photosensitive unit such that a gap between the developing sleeve and a photosensitive rotating member included in the photosensitive unit is maintained at a predetermined value, the developing unit comprising:

a pair of bearings that rotatably hold the developing sleeve at edges of axial ends thereof;

a pair of support parts that each support a corresponding one of the bearings by being brought into contact with the bearing;

a voltage applying member that is inserted into the developing sleeve to be in contact with an inner circumferential surface of the developing sleeve to apply a voltage to the developing sleeve; and a retaining member that retains the voltage applying member inside the developing sleeve, wherein:

the voltage applying member comprises:

a coil part that is formed from a helically-wound element wire having conductivity and elasticity; and an extending part that is continuous with one of ends of the coil part and extends along a central axis of the coil part, the developing sleeve is longer in a rotational axis direction thereof than an element tube of the photosensitive rotating member in a rotational axis direction thereof, the bearings are provided outward from axial ends of the element tube, the gap is maintained at the predetermined value by the developing unit being relatively forced to bring each of the bearings into abutment with an abutment part of a corresponding one of a pair of support frames included in the photosensitive unit, the retaining member retains the voltage applying member while pressing the other end of the coil part toward a part of one of the bearings which faces an opening provided at one of the ends of the developing sleeve and bringing the extending part into elastic abutment with the inner circumferential surface of the developing sleeve, and the bearing has a conductive member provided at the part thereof which is in abutment with the other end of the coil part, and a developing bias voltage is applied to the developing sleeve via the conductive member and the voltage applying member.

14. The developing unit of claim 13, wherein the bearings are each a slide bearing that is brought into sliding contact with an outer circumference surface or an inner circumference surface of a corresponding one of the edges of the axial ends of the developing sleeve, thereby rotatably holding the developing sleeve, and the surfaces of the edges of the ends of the developing sleeve that are brought into sliding contact with the bearings have undergone surface processing for improving slidability or abrasion resistance.

15. The developing unit of claim 14, wherein the surface processing is plating processing.

16. The developing unit of claim 14, wherein the surface processing is mirror finishing.

17. The developing unit of claim 13, further comprising a magnet roller that is coaxially inserted into the developing sleeve, wherein the bearings each have a holding part that holds a corresponding one of axial ends of the magnet roller.

18. The developing unit of claim 17, wherein the holding part is a through-hole or a concave part, the magnet roller has a shaft, and the axial end of the shaft of the magnet roller is fit into the holding part.

19. The developing unit of claim 17, wherein the holding part is a convex part, and the magnet roller has a concave part at the axial end thereof into which the convex part is fitted.

20. The developing unit of claim 13, further comprising a pair of support parts supporting a corresponding one of the bearings by being brought into contact with the bearing at a side thereof opposite to the abutment part of the support frame, wherein the support part is provided such that when seen in a direction in which the bearing is forced toward the support frame, an abutment range between the abutment part of the support frame and the bearing at least partially overlaps a contact range between the bearing and the support part.

21. The developing unit of claim 13, wherein the developing sleeve is driven to rotate such that, at a position at which the developing sleeve and the photosensitive rotating member oppose each other, a rotational direction of the developing sleeve is counter to a rotational direction of the photosensitive rotating member.

22. The developing unit of claim 13, further comprising an external gear that is externally fit onto the developing sleeve, wherein the developing sleeve receives a driving force from a driving source via the external gear.

23. The developing unit of claim 13, wherein the extending part has a bent part that is bent outward in a radial direction of the developing sleeve to have a mound shape, and a tip of the bent part is in abutment with the inner circumferential surface of the developing sleeve.

* * * * *